US009401256B2

(12) United States Patent
Fujimoto et al.

(10) Patent No.: US 9,401,256 B2
(45) Date of Patent: Jul. 26, 2016

(54) ELECTROMAGNETIC RELAY

(71) Applicant: OMRON Corporation, Kyoto-shi, Kyoto (JP)

(72) Inventors: Koji Fujimoto, Kumamoto (JP); Akifumi Fujino, Kumamoto (JP); Bin Wang, Shanghai (CN); Kaori Hirano, Kumamoto (JP); Ayumi Noguchi, Kumamoto (JP)

(73) Assignee: OMRON Corporation, Kyoto (JP)

( * ) Notice: Subject to any disclaimer, the term of this patent is extended or adjusted under 35 U.S.C. 154(b) by 27 days.

(21) Appl. No.: 14/391,295

(22) PCT Filed: Apr. 9, 2013

(86) PCT No.: PCT/JP2013/060747
§ 371 (c)(1),
(2) Date: Oct. 8, 2014

(87) PCT Pub. No.: WO2013/154110
PCT Pub. Date: Oct. 17, 2013

(65) Prior Publication Data

US 2015/0116061 A1 Apr. 30, 2015

(30) Foreign Application Priority Data

Apr. 9, 2012 (JP) ..... 2012-088551

(51) Int. Cl.
*H01H 51/22* (2006.01)
*H01H 50/64* (2006.01)
(Continued)

(52) U.S. Cl.
CPC ..... *H01H 50/643* (2013.01); *H01H 50/36* (2013.01); *H01H 50/24* (2013.01)

(58) Field of Classification Search
CPC ... H01H 50/641; H01H 50/643; H01H 50/58; H01H 50/24; H01H 50/026; H01H 50/64; H01H 50/44; H01H 53/00; H01H 67/02; H01H 3/00; H01H 51/22; H01H 9/48; H01F 7/08
USPC ..... 335/78
See application file for complete search history.

(56) References Cited

U.S. PATENT DOCUMENTS 3,825,865 A * 7/1974 Prouty ..... H01H 50/24 200/280
4,405,911 A * 9/1983 Hasegawa ..... H01H 50/02 335/135

(Continued)

FOREIGN PATENT DOCUMENTS

JP H02-273431 A 11/1990
JP 6-12960 A 1/1994

(Continued)

OTHER PUBLICATIONS

International Search Report for corresponding International Application No. PCT/JP2013/060747, mailed May 21, 2013 (1 page).

(Continued)

*Primary Examiner* — Shawki S Ismail
*Assistant Examiner* — Lisa Homza
(74) *Attorney, Agent, or Firm* — Osha Liang LLP

(57) ABSTRACT

An electromagnetic relay has an iron core having legs at both ends and a coil wound therearound to form an electromagnet, a movable iron piece that pivotally supports a pivoting shaft along one leg of the iron core and causes a tip of a pivoting arm extended from a side edge of the pivoting shaft toward the other leg of the iron core to face the other leg of the iron core in a contactable and separable manner, and a card whose side facing the movable iron piece is in contact with the pivoting arm of the movable iron piece. The movable iron piece that pivots based on the excitation and degaussing of the electromagnet presses the card to drive a contact mechanism.

8 Claims, 25 Drawing Sheets

(51) Int. Cl.
*H01H 50/36* (2006.01)
*H01H 50/24* (2006.01)

(56) References Cited

U.S. PATENT DOCUMENTS 5,191,306 A * 3/1993 Kaji ..... H01H 50/16 335/128
5,844,456 A * 12/1998 Mader ..... H01H 50/026 335/128
7,872,551 B2 * 1/2011 Nakamura ..... H01H 50/041 200/16 R
8,922,307 B2 * 12/2014 Fujimoto ..... 335/129
2002/0050883 A1 * 5/2002 Miyazaki ..... H01H 50/36 335/128
2008/0231398 A1 * 9/2008 Minowa ..... H01H 50/56 335/196
2010/0225427 A1 * 9/2010 Fujimoto ..... H01H 50/043 335/2
2010/0225428 A1 * 9/2010 Fujimoto ..... H01H 50/24 335/189
2013/0293324 A1 * 11/2013 Fujimoto ..... H01H 50/026 335/156
2015/0116061 A1 * 4/2015 Fujimoto ..... H01H 50/36 335/189

FOREIGN PATENT DOCUMENTS

JP 9-326226 A 12/1997
JP 2003-115248 A 4/2003

OTHER PUBLICATIONS

Extended European Search Report issued in corresponding European Application No. 13775847.0, mailed on Nov. 23, 2015 (7 pages).

* cited by examiner

ELECTROMAGNETIC RELAY

BACKGROUND

1. Field

The present invention relates to an electromagnetic relay, and in particular, to a drive mechanism of a gate-shaped iron core and movable iron piece.

2. Related Art

There is an electromagnetic relay that includes a nearly C-shaped, plate-shaped yoke having a horizontally extending body and legs extending downward from both ends of the body; an insulating winding frame having a winding body attached to the body and an excitation coil wound around the winding body; an armature having a horizontal part horizontally extending and having an insulating operating piece, a pivoting shaft extending from one end of the horizontal part in the extending direction of one leg out of the legs, and a vertical part extending from the other end of the horizontal part and coming into contact with the other leg out of the legs when the excitation coil is excited; an insulating base housing supporting the both legs of the yoke and having a recess or a hole receiving a shaft piece formed at the lower end of the pivoting shaft of the armature, the base housing having an insulating wall extending between the excitation coil and the armature; and a movable contacting piece and a fixed contacting piece that are arranged below the excitation coil and between the both legs of the yoke to be attached to the base housing and come into contact with each other by the pressing of the operating piece, the base housing having a second insulating wall isolating the movable and fixed contacting pieces and the armature from each other, and the operating piece pressing the movable contacting piece through a hole formed at nearly the central part of the second insulating wall (refer to Patent Literature 1).

As illustrated in its FIG. 2, in the above electromagnetic relay, a pivoting shaft 62 of an armature 60 is in contact with the surface of one leg 42 of a plate-shaped yoke 40, and the armature 60 pivots about a rectangular shaft piece 62*a* and a rectangular shaft piece 62*b* formed on the same axis. This causes a protrusion 65 of an operating piece 64 to drive a movable contacting piece 21 and causes a movable contact 21*d* to connect to and disconnect from a fixed contact 22*d*.

In particular, the above electromagnetic relay arranges the protrusion 65 at a position downwardly deviated from the central position between the rectangular shaft piece 62*a* and the rectangular shaft piece 62*b*. When a voltage is applied to an excitation coil 56 of an operating electromagnet 30, the pivoting shaft 62 of the armature 60 pivots while remaining to be attracted to the one leg 42 of the plate-shaped yoke 40. When the protrusion 65 of the operating piece 64 comes into contact with an elastic spring piece 21*c*, a torsional moment about a line connecting between the rectangular shaft piece 62*a* and the protrusion 65 acts on the armature 60. Because a larger pivot angle of the armature 60 increases the torsional moment, the rectangular shaft piece 62*a* of the armature 60 departs from the one leg 42, and the tip edge of a vertical part 63 is attracted to the other leg 43 of the plate-shaped yoke 40.

This causes the armature 60 to be supported by three points, that is, the rectangular shaft piece 62*b* above the armature 60, the protrusion 65 of the operating piece 64, and the tip edge of the vertical part 63 of the armature 60, thereby achieving a stable state.

CITATION LIST

Patent Literature

Patent Literature 1: Japanese Patent Application Laid-open No. 2003-115248

SUMMARY

However, because the pivoting shaft 62 of the armature 60 is uniformly attracted to the one leg 42 of the plate-shaped yoke 40 in the above electromagnetic relay, the rectangular shaft piece 62*a* of the armature 60 is difficult to depart from the one leg 42. Thus, variations in operating voltage until the armature 60 is stabilized may occur, leading to an inability to achieve an electromagnetic relay having stable operating characteristics.

One or more embodiments of the present invention provides an electromagnetic relay in which a movable iron piece is stabilized at an early stage and that has stable operating characteristics.

An electromagnetic relay according to one or more embodiments of the present invention includes an iron core having legs at both ends and a coil wound therearound to form an electromagnet; a movable iron piece that pivotally supports a pivoting shaft along one leg of the iron core and causes a tip of a pivoting arm extended from a side edge of the pivoting shaft toward the other leg of the iron core to face the other leg of the iron core in a contactable and separable manner; and a card whose side facing the movable iron piece is in contact with the pivoting arm of the movable iron piece. The movable iron piece that pivots based on the excitation and degaussing of the electromagnet presses the card, thereby driving a contact mechanism. At least one facing plane out of the facing planes of the one leg of the iron core and the pivoting shaft of the movable iron piece includes magnetic flux density reduction mechanism.

One or more embodiments of the present invention includes the magnetic flux density reduction mechanism at least one facing plane out of the facing planes of the one leg of the iron core and the pivoting shaft of the movable iron piece. Owing to this, when the movable iron piece pivots based on the excitation and degaussing of the electromagnet and comes into contact with the card, thereby producing a torsional moment in the movable iron piece, one shaft of the pivoting shaft of the movable iron piece departs from the leg of the iron core at an early stage of a stroke. Being supported by three points, that is, the other shaft of the movable iron piece, the card, and the tip of the pivoting arm, a stable state is achieved at an early stage. This achieves an electromagnetic relay that causes no variation in operating voltage and has stable operating characteristics.

In one or more embodiments of the present invention, the magnetic flux density reduction mechanism may be a groove or a protrusion.

According to one or more embodiments of the present invention, the magnetic flux density reduction mechanism may be manufactured by simple press working to achieve an electromagnetic relay with high productivity.

In one or more embodiments of the present invention, the magnetic flux density reduction mechanism may be a non-magnetic body.

One or more embodiments of the present invention increases the degree of flexibility in designing the magnetic flux density reduction mechanism.

In one or more embodiments of the present invention, the tip of the pivoting arm may be L-shaped so as to be along the other leg of the iron core.

One or more embodiments of the present invention forms an extended part extended upward from the tip, thereby producing the effect of achieving an electromagnetic relay having desired magnetic characteristics.

DETAILED DESCRIPTION

Figure 1A:
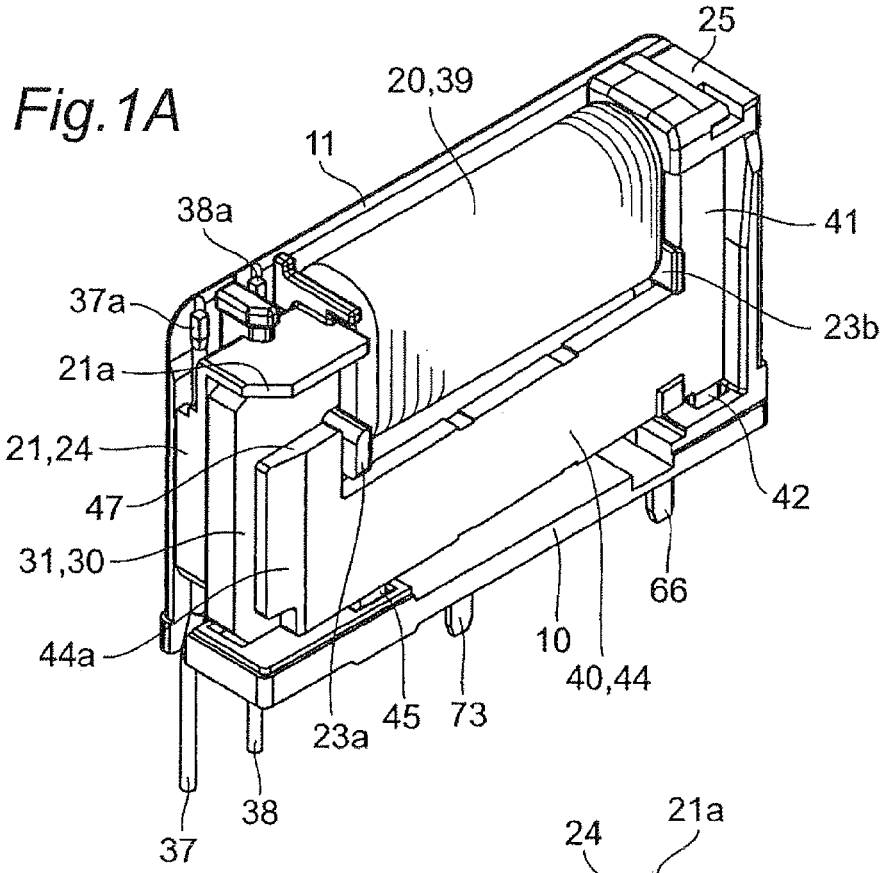
FIGS. 1A, 1B are perspective views viewing an electromagnetic relay according to a first embodiment of the present invention from different angles.

Embodiments of the present invention will be described with reference to the attached drawing of FIG. 1A to FIG. 25. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention.

As illustrated in FIG. 1A to FIG. 18, the electromagnetic relay according to the first embodiment basically includes a base 10, an electromagnet 20, a movable iron piece 40, a card 50, a contact mechanism 60, and a case 80.

Figure 1B:
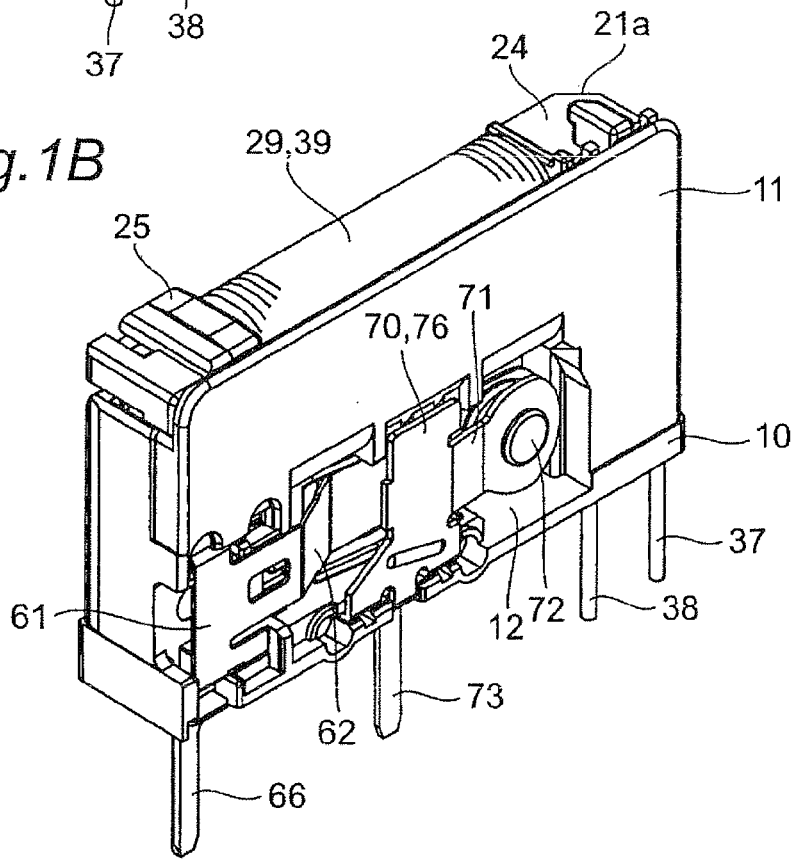

For the convenience of description, the case 80 is not illustrated in FIGS. 1A-1B. The first embodiment defines a side on which the electromagnet 20 is assembled to the base 10 as a front side (FIG. 2) and defines a side on which the contact mechanism 60 is assembled to the base 10 as a back side (FIG. 3).

As illustrated in FIGS. 8A-8B and FIGS. 9A-9C, the base 10 integrally forms an insulating wall 11 having a nearly L shape in a plan view along adjacent sides on the periphery of the upper face thereof. The insulating wall 11 expands its part toward the front side, thereby forming a recess 12 in which the contact mechanism 60 described below can be arranged. A square operating hole 13 through which an operating protrusion 52 of the card 50 described below can be inserted is formed at nearly the central part of the recess 12.

Figure 9A:
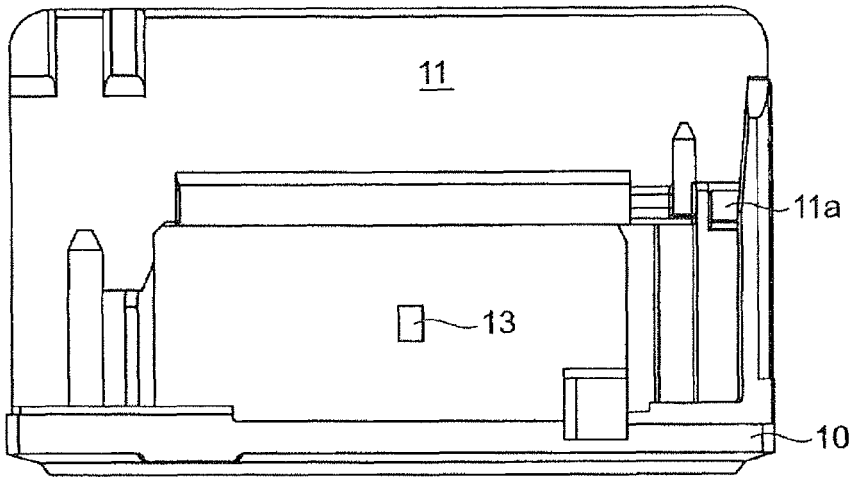
FIGS. 9A, 9B, and 9C are an elevational view, a top view, and a back view, respectively, of the base illustrated in FIGS. 1A-1B.
Figure 9B:
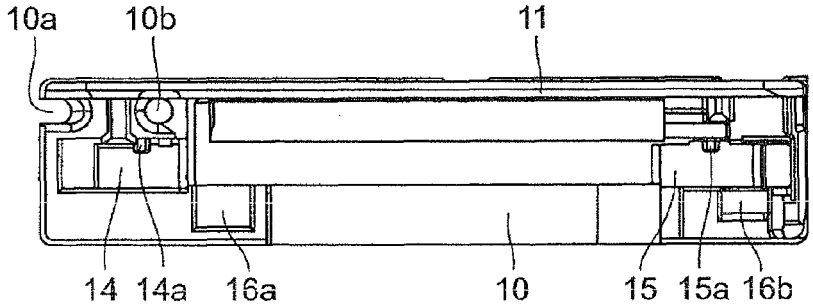

As illustrated in FIG. 9B, the base 10 forms a pair of pressing-in recesses 14, 15 near the front-side base of the insulating wall 11 in order to assemble a gate-shaped iron core 30 described below. The pressing-in recesses 14, 15 form crushing protrusions 14*a*, 15*a*, respectively, at the base of the inner side face thereof. A retaining hole 16*a* for retaining the movable iron piece 40 described below is formed at a position adjacent to the pressing-in recess 14, whereas a shaft receiving part 16*b* for supporting the movable iron piece 40 is formed at position adjacent to the pressing-in recess 15. A terminal notch 10*a* and a terminal hole 10*b* through which coil terminals 37, 38 described below are inserted are formed between the pressing-in recess 14 and the insulating wall 11.

Figure 9C:
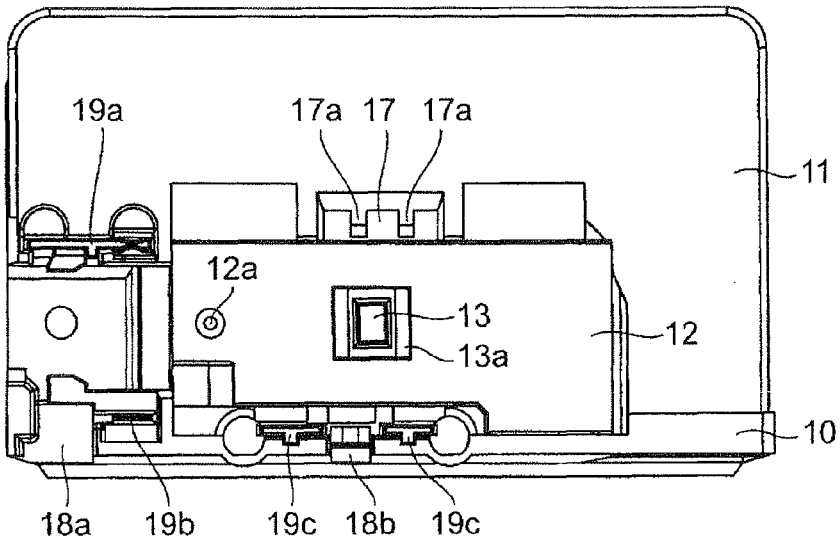

As illustrated in FIG. 9C, the base 10 forms the square operating hole 13 at nearly the central part of the recess 12 formed on the back side of the insulating wall 11 as described above. The base 10 forms a surrounding rib 13*a* around the operating hole 13 and protrudes a support protrusion 12*a* at a position adjacent to the operating hole 13. The base 10 forms on the periphery thereof a movable contact terminal notch 18*a* and a fixed contact terminal notch 18*b* in an area positioned on the opening edge of the recess 12. A fixed contact terminal positioning step 17 having a tapered face is formed in an area positioned on the opening edge of the recess 12 on the insulating wall 11. Seal reservoirs 17*a* (FIG. 7C) having a nearly triangular cross section formed by a tapered face are formed side by side in the inner corner of the fixed contact terminal positioning step 17. The base 10 forms pressing-in grooves 19*a*, 19*b* at positions adjacent to the recess 12 and forms pressing-in grooves 19*c*, 19*c* at both sides of the fixed contact terminal notch 18*b*.

Figure 10A:
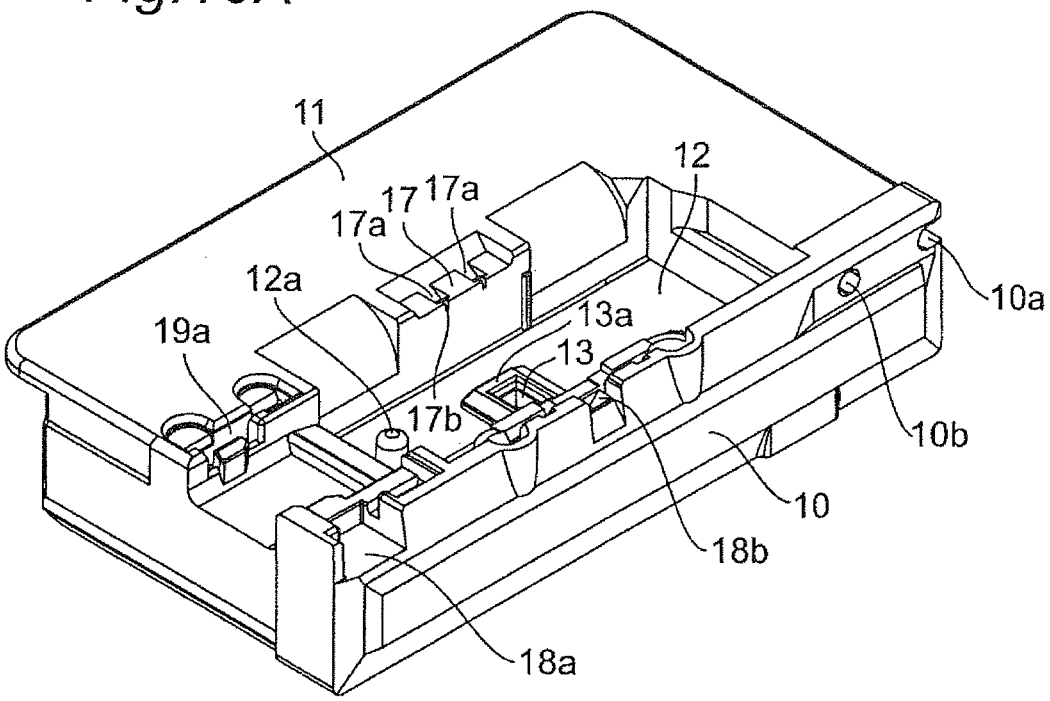
FIG. 10A is a perspective view illustrating a modification of the base illustrated in FIGS. 1A-1B.
Figure 10B:
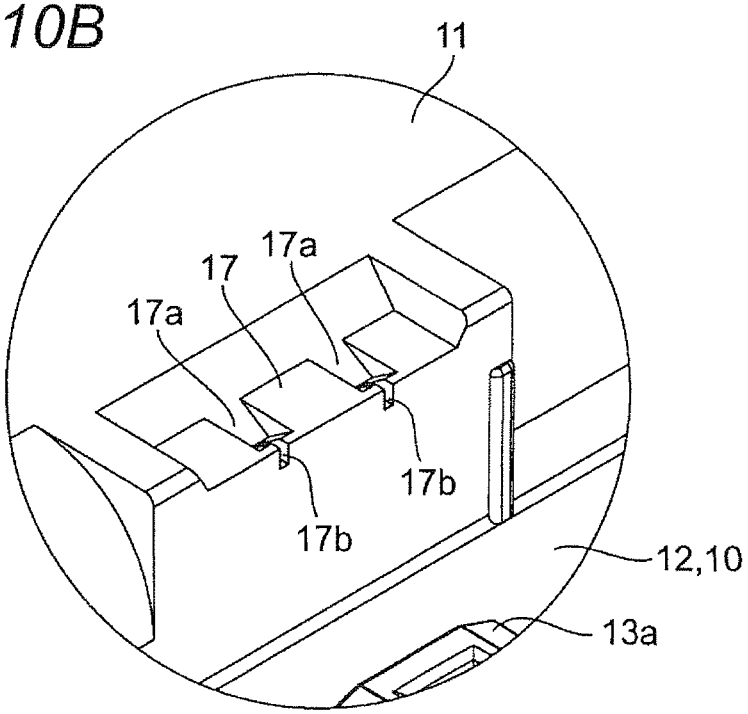
FIG. 10B is a partial enlarged view of FIG. 10A.

As illustrated in FIGS. 10A, 10*b*, the seal reservoirs 17*a* may form ventilation grooves 17*b* so as to facilitate and ensure the injection of a sealant (not illustrated).

Figure 11A:
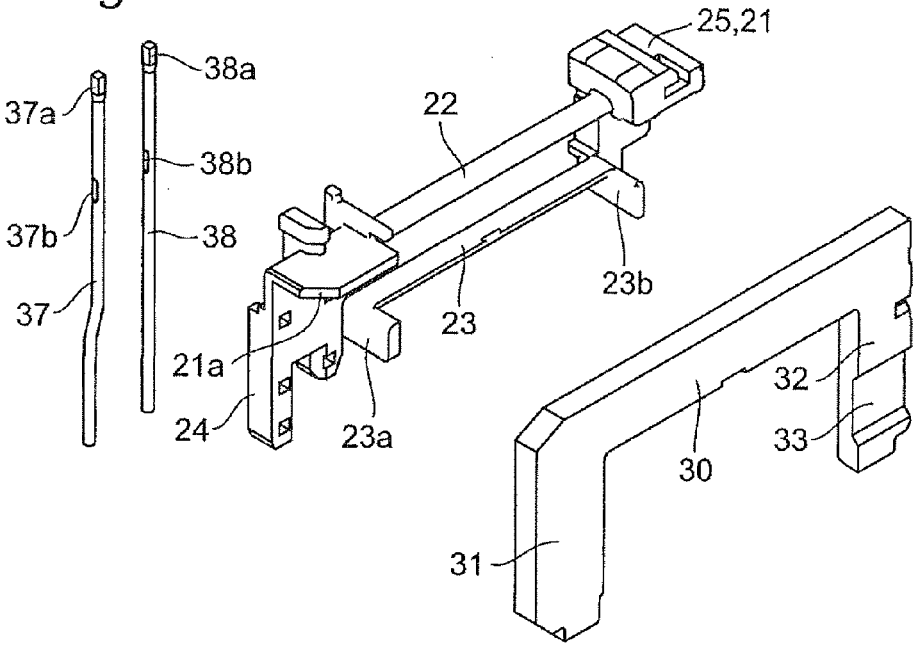
FIGS. 11A, 11B are exploded perspective views viewing components of an electromagnet from different angles.
Figure 11B:
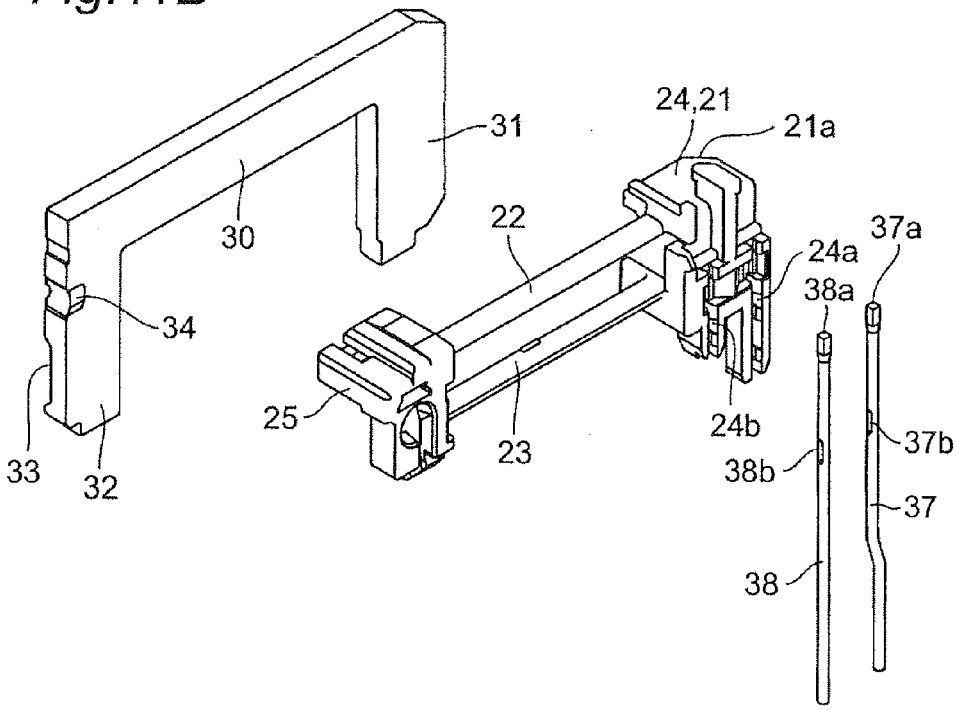
Figure 12A:
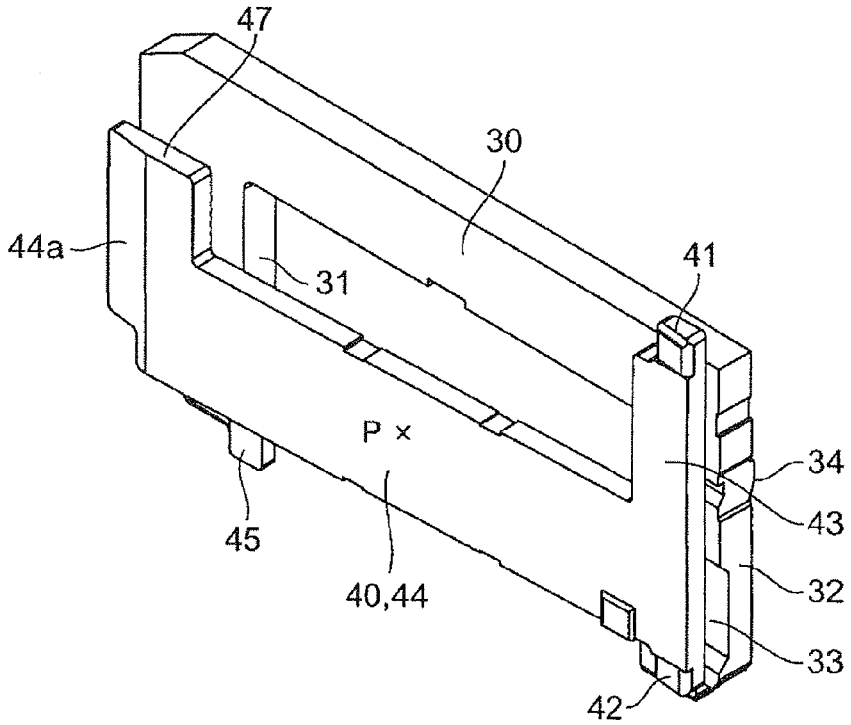
FIGS. 12A, 12B are perspective views viewing a state in which a movable iron piece is assembled to an iron core from different angles.
Figure 12B:
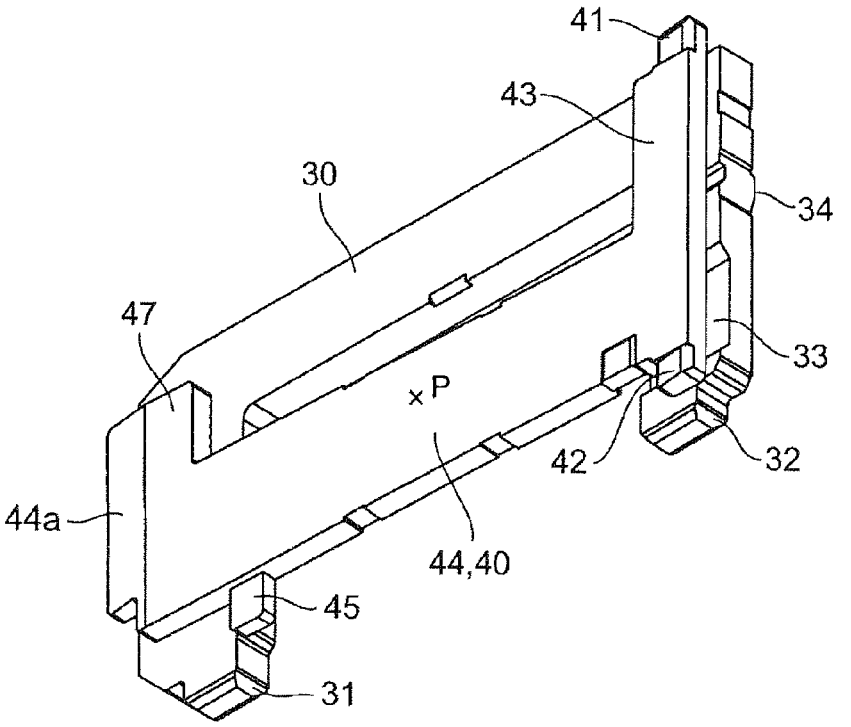

As illustrated in FIGS. 11A-11B, the electromagnet 20 is formed by assembling the gate-shaped iron core 30 and a pair of coil terminals 37, 38 to a spool 21 and winding a coil 39 therearound.

As illustrated in FIG. 11A, the spool 21 integrally connects a pair of collars 24, 25 with a pair of parallel rod-shaped connecting members 22, 23. Arms 23*a*, 23*b* for holding the gate-shaped iron core 30 described below are protruded sideward from both ends of the rod-shaped connecting member 23.

As illustrated in FIG. 11B, pressing-in grooves 24*a*, 24*b* for pressing in and holding the coil terminals 37, 38 described below are arranged side by side on the back side of the collar 24. Retaining protrusions (not illustrated) having a nearly triangular cross section are formed on the respective faces facing the pressing-in grooves 24*a*, 24*b* along the axial direction.

Figure 5A:
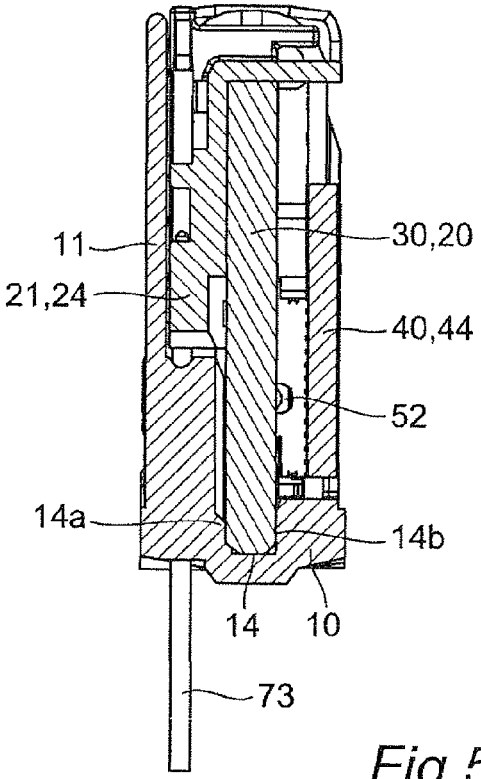
FIG. 5A is a left-side sectional view of the electromagnetic relay illustrated in FIGS. 1A-1B.
Figure 5C:
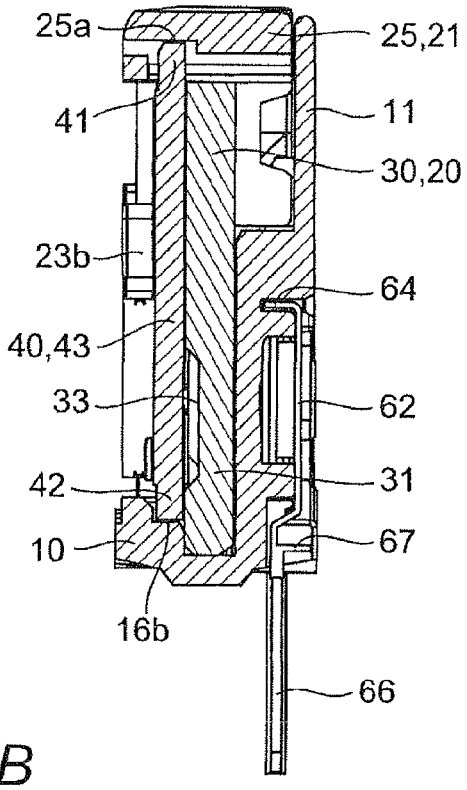
FIG. 5C is a right-side sectional view of the electromagnetic relay illustrated in FIGS. 1A-1B.

As illustrated in FIG. 5C, a shaft receiving part 25*a* is formed on the ceiling of the collar 25 for pivotally supporting a shaft 41 of the movable iron piece 40 described below.

As illustrated in FIGS. 11A-11B, the gate-shaped iron core 30 is formed by stamping a plate-shaped magnetic material into a gate shape, in which one leg 32 out of both legs 31, 32 forms a shallow groove 33 for reducing magnetic flux density on the lower front side thereof and protrudes a protruding protrusion 34 from the outer edge of the leg 32 toward the back side.

The magnetic flux density reduction mechanism may be formed on either one or both of the facing faces of the leg 32 of the gate-shaped iron core 30 and a pivoting shaft 43 of the movable iron piece 40 described below. In particular, according to one or more embodiments of the present invention, it is formed below a line connecting between the shaft 41 of the movable iron piece 40 and the pressing point P of the operating protrusion 52 of the card 50 described below.

As illustrated in FIGS. 11A-11B, the coil terminals 37, 38 are formed in a pin shape having a circular cross section, in which binding parts 37*a*, 38*a* having a square cross section at the upper end thereof, and whirl-stops 37*b*, 38*b* having a nearly square cross section formed by press working are formed at the middle thereof.

The cross section of the binding parts 37*a*, 38*a* is not limited to square, may be rectangle, triangle, and ellipse, and, according to one or more embodiments of the present invention, is a shape having an edge that can cut the coil 39.

The gate-shaped iron core 30 is assembled to the arms 23*a*, 23*b* of the spool 21, whereas the coil terminals 37, 38 are pressed in the pressing-in grooves 24*a*, 24*b*, respectively, of the collar 24 and are engaged with and fixed to the retaining protrusions formed within the pressing-in grooves 24*a*, 24*b*. The binding parts 37*a*, 38*a* of the coil terminals 37, 38 are bent sideward, and then the coil 39 is wound around the rod-shaped connecting members 22, 23 and the gate-shaped iron core 30. A lead wire of the coil 39 is bound to the binding parts 37*a*, 38*a* of the coil terminals 37, 38, and the coil 39 is cut by the edges thereof and is soldered. Next, the binding parts 37*a*, 38*a* are bent and raised to complete the electromagnet 20.

The assembly of the electromagnet 20 to the base 10 is required to be performed concurrently with the movable iron piece 40, which will be described later.

Figure 2:
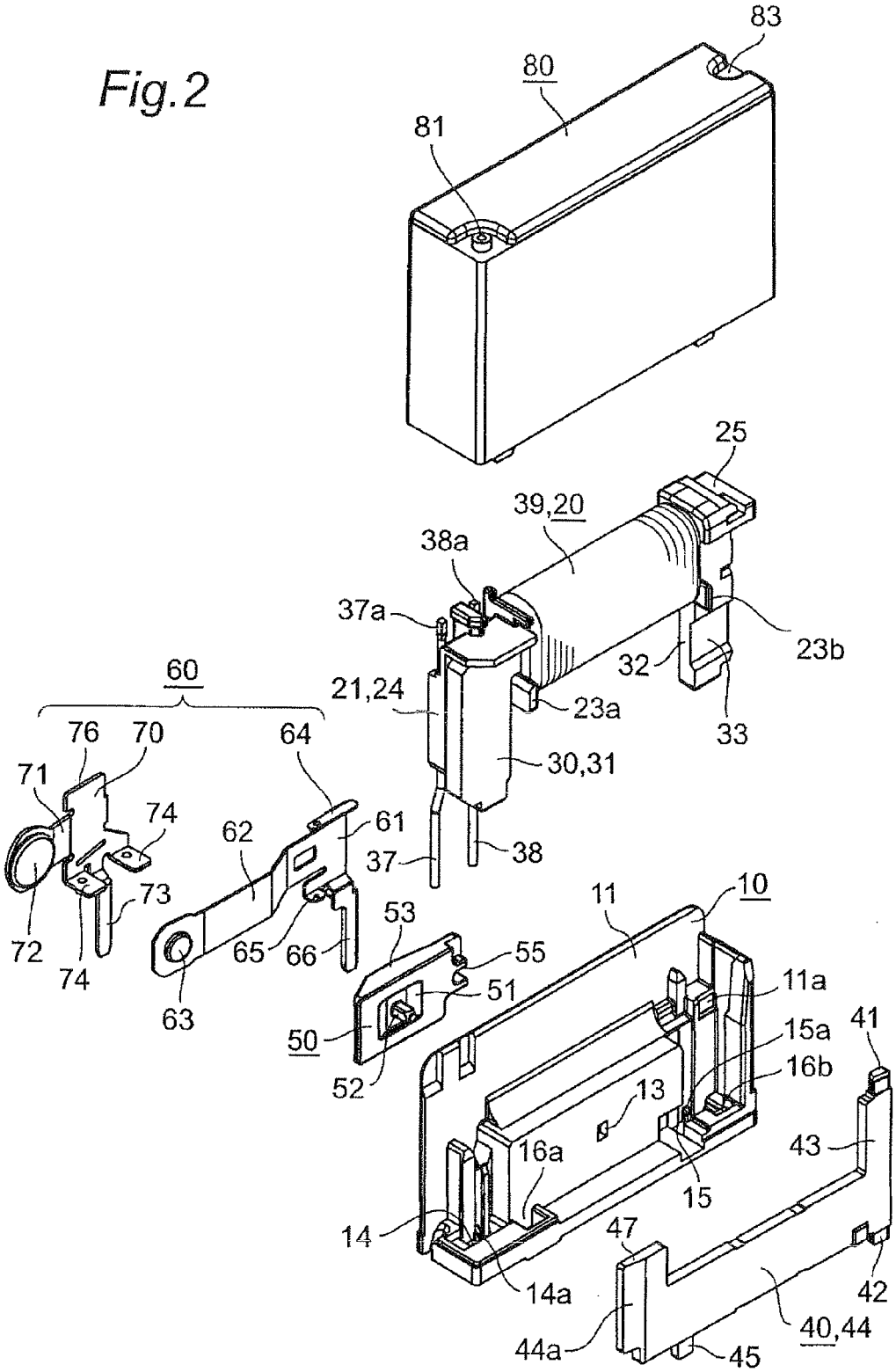
FIG. 2 is an exploded perspective view of the electromagnetic relay viewed from the same viewpoint as that of FIG. 1A.
Figure 3:
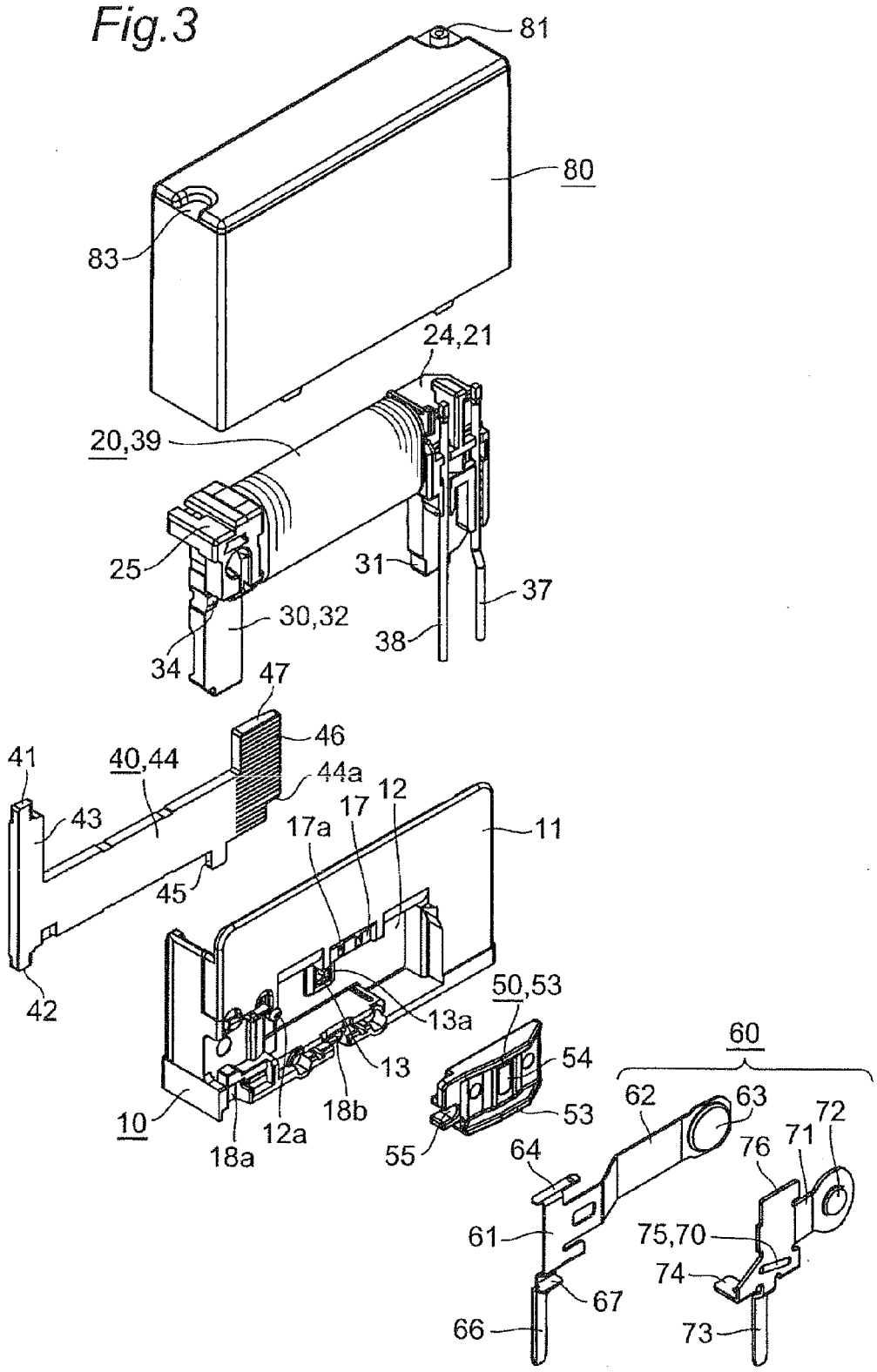
FIG. 3 is an exploded perspective view of the electromagnetic relay viewed from the same viewpoint as that of FIG. 1B.

As illustrated in FIGS. 2, 3, the movable iron piece 40 includes the pivoting shaft 43 forming shafts 41, 42 at the upper and lower ends thereof and an L-shaped pivoting arm 44 having an extended part 47 that extends sideward from the lower half of the pivoting shaft 43 and extends upward from a tip 44*a*. A retaining protrusion 45 is protruded from the lower periphery of the pivoting arm 44, whereas many protrusions 46 are formed side by side on the back side of the tip 44*a* by press working. The protrusions 46 are formed in order to prevent sticking between the movable iron piece 40 and the gate-shaped iron core 30 caused by an adhesive substance generated by arc.

The pivoting arm 44 is not necessarily required to be an L shape and may be a shape in which the tip 44*a* of the pivoting arm 44 is bent. It may be a simple strip shape.

When the electromagnet 20 and the movable iron piece 40 are assembled to the base 10, the shaft 41 of the movable iron piece 40 is positioned onto the shaft receiving part 25*a* formed on the collar 25 of the spool 21, thereby overlaying the movable iron piece 40 on the gate-shaped iron core 30. The respective tips of the legs 31, 32 of the gate-shaped iron core 30 are pressed in the pressing-in recesses 14, 15 of the base 10, thereby crushing the crushing protrusions 14*a*, 15*a* formed within the pressing-in recesses 14, 15, respectively. This causes the respective tips of the legs 31, 32 to be pressed against the inner side faces of the pressing-in recesses 14, 15 and are positioned (refer to FIG. 5B). At the same time, the protruding protrusion 34 formed in the gate-shaped iron core 30 is fitted into a positioning recess 11*a* (FIG. 2) formed on the insulating wall 11. The shaft 42 of the movable iron piece 40 is pivotally loosely fitted into the shaft receiving part 16*b* of the base 10, whereas the retaining protrusion 45 is fitted into the retaining hole 16*a* of the base 10 to retain it.

Figure 5B:
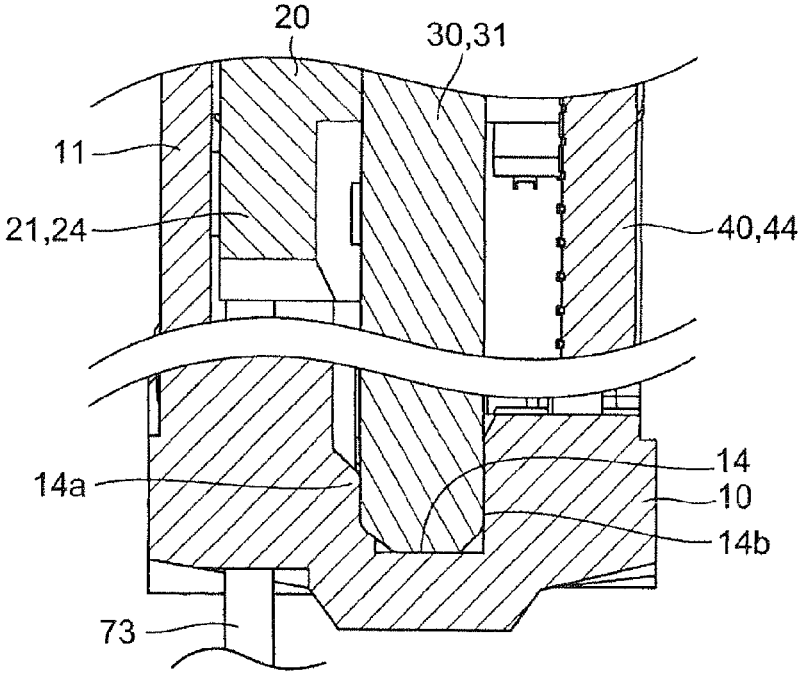
FIG. 5B is a partial enlarged view of FIG. 5A.
Figure 6A:
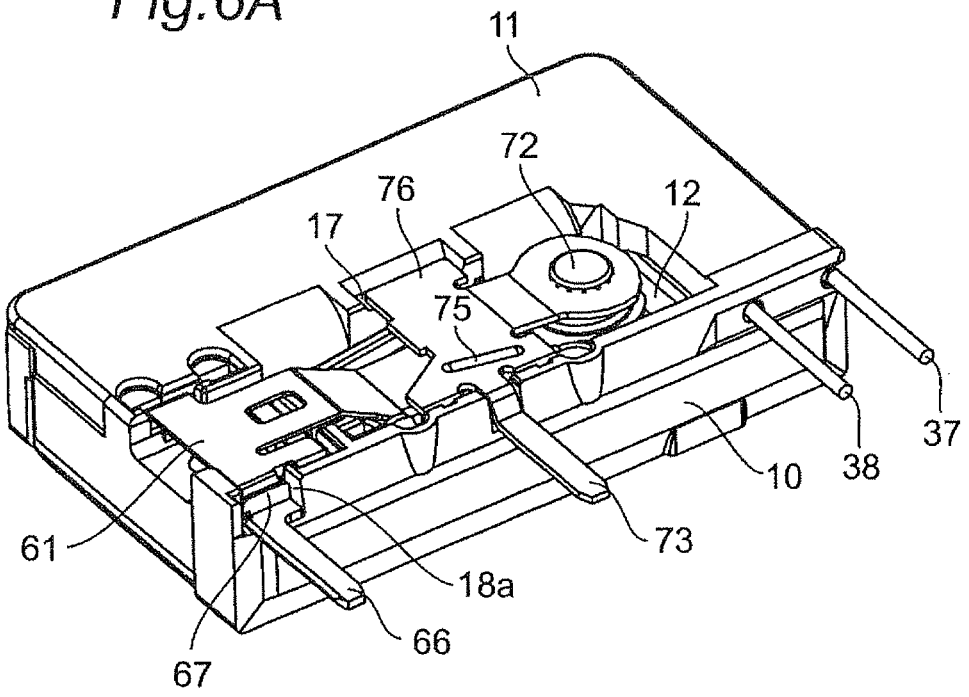
FIG. 6A is a perspective view of the electromagnetic relay illustrated in FIG. 1B.
Figure 6B:
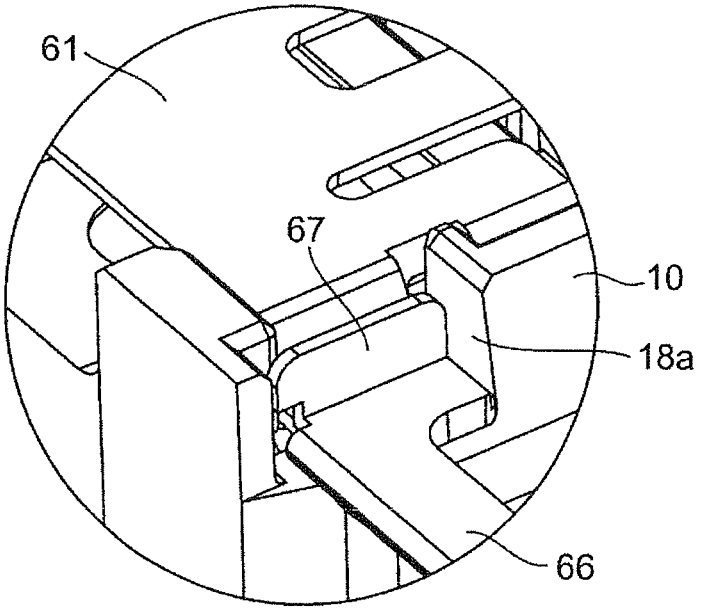
FIG. 6B is a partial enlarged view of FIG. 6A.
Figure 7A:
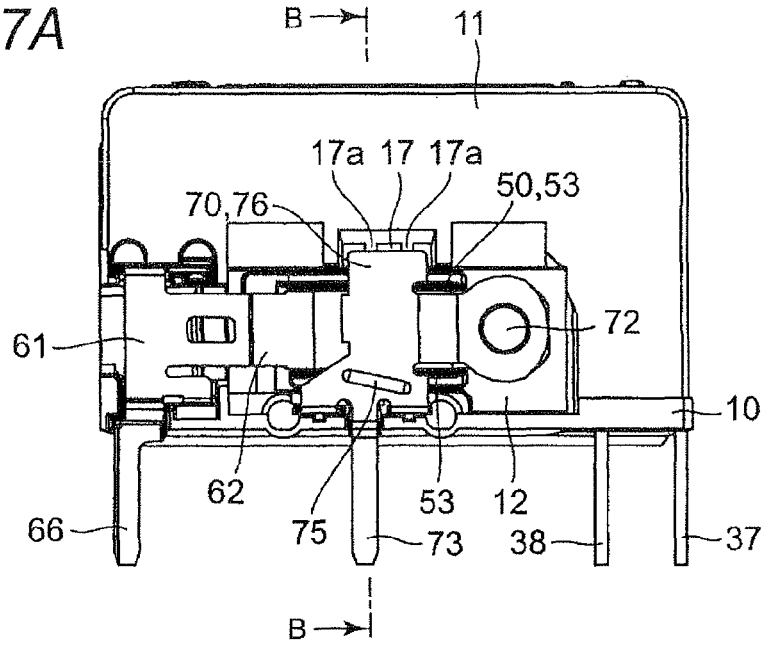
FIG. 7A is an elevational view of the electromagnetic relay illustrated in FIG. 1B.
Figure 7B:
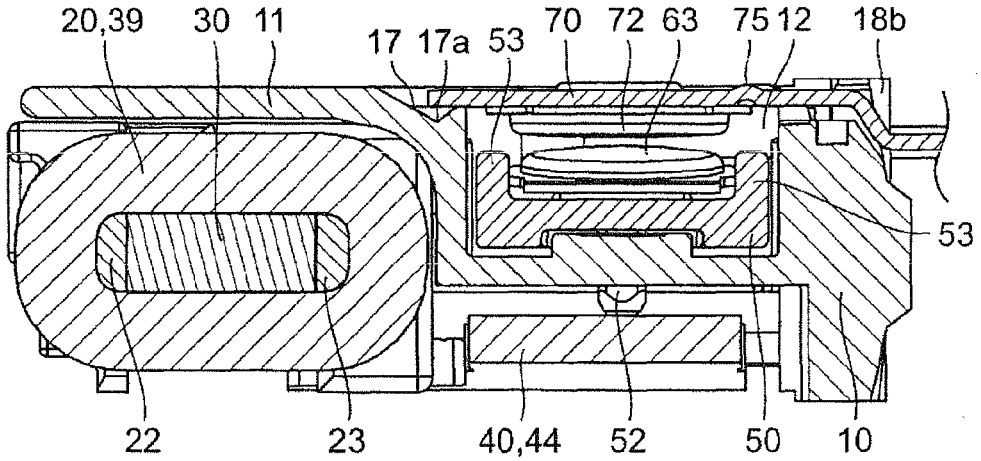
FIG. 7B is a B-B line partial enlarged sectional view of FIG. 7A.
Figure 7C:
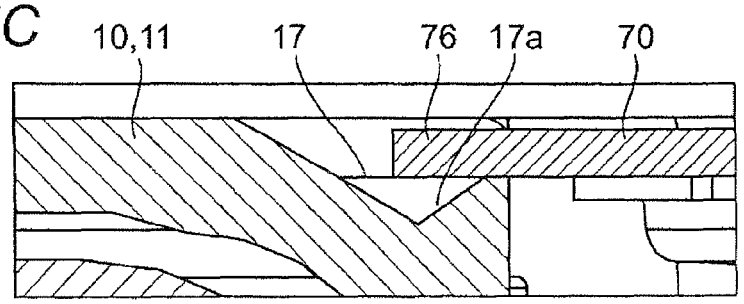
FIG. 7C is a principal part enlarged view of FIG. 7B.
Figure 8A:
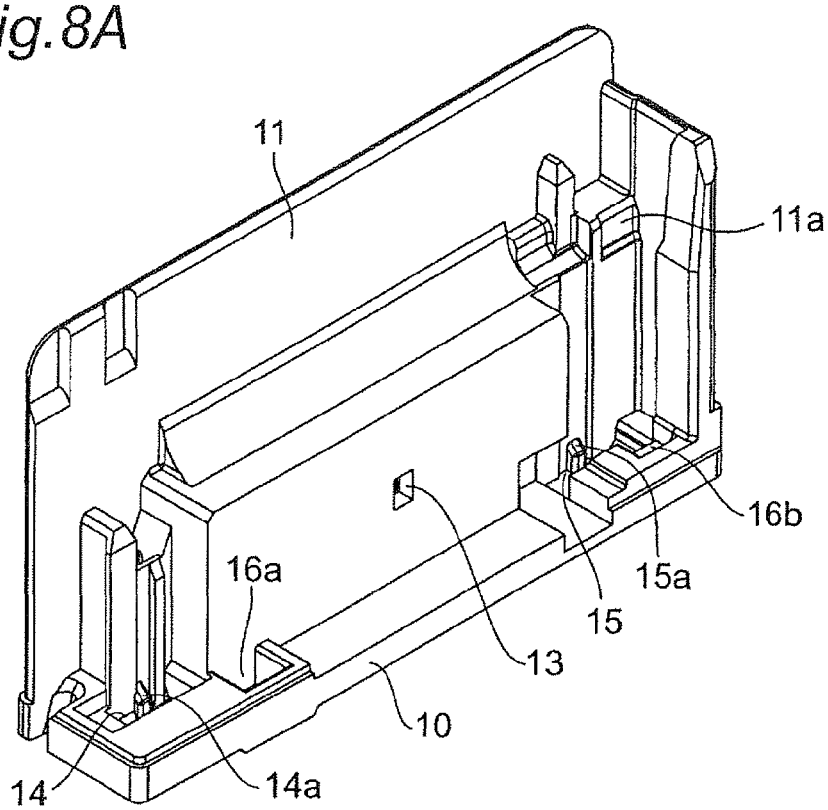
FIGS. 8A, 8B are perspective views viewing a base illustrated in FIGS. 1A-1B from different angles.
Figure 8B:
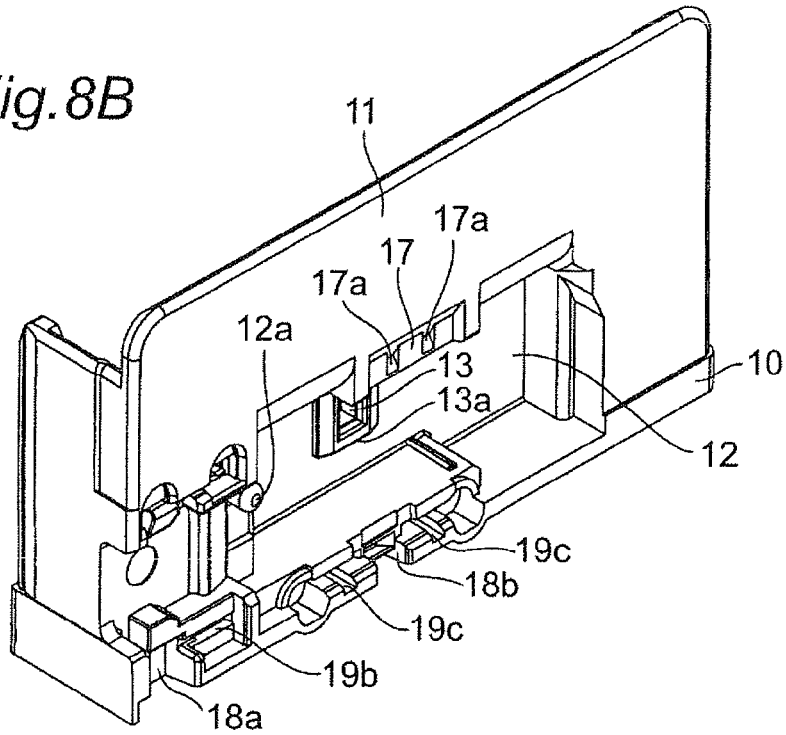

As illustrated in FIGS. 5A, 5B, 5C, when the electromagnet 20 is assembled to the base 10, the collars 24, 25 of the spool 21 are not in contact with the insulating wall 11 of the base 10, and only the gate-shaped iron core 30 is in contact with the base 10. This reduces the assembly error of the electromagnet 20 with respect to the base 10 and gives high positioning accuracy, thereby causing the advantage of achieving an electromagnetic relay ensuring designed support strength and having good operating characteristics.

Figure 4A:
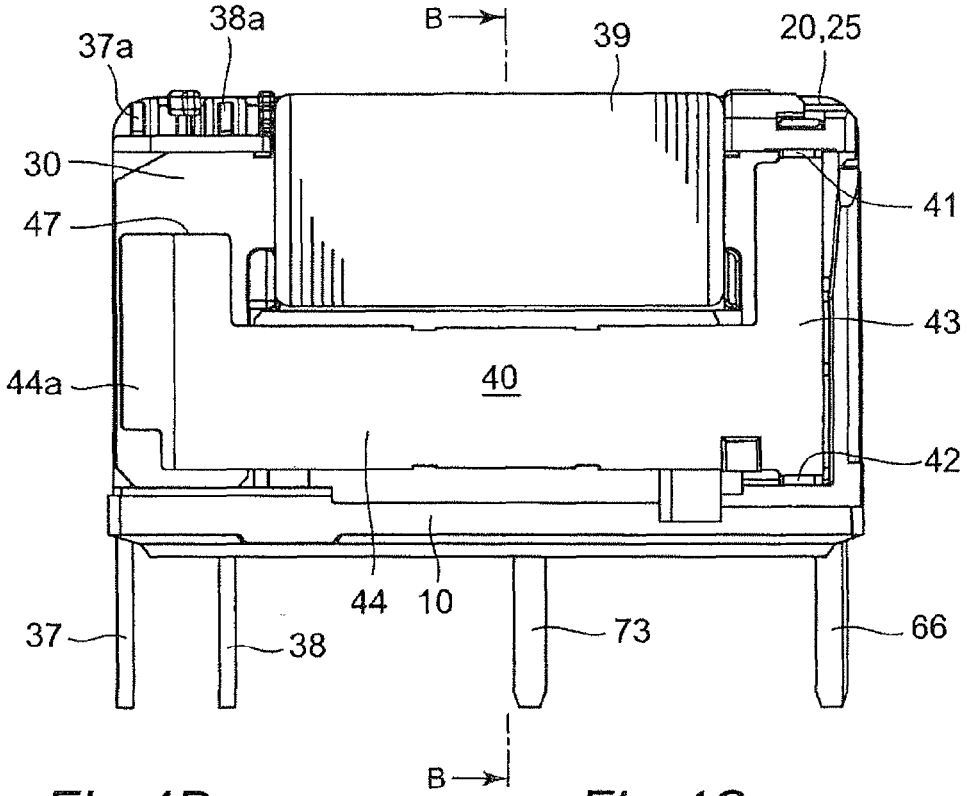
FIG. 4A is an elevational view of the electromagnetic relay illustrated in FIG. 1A.
Figure 4B:
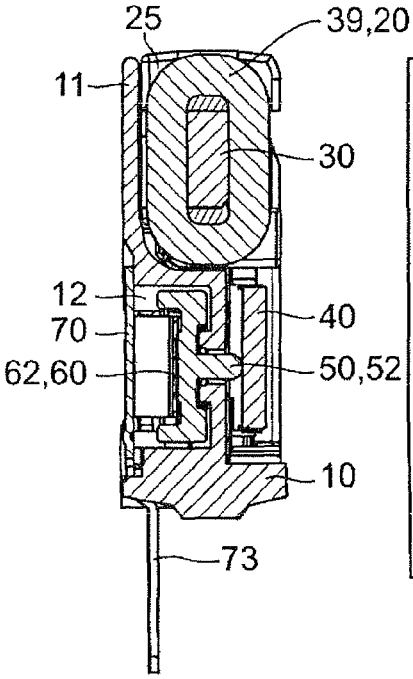
FIG. 4B is a B-B line sectional view of FIG. 4A.
Figure 4C:
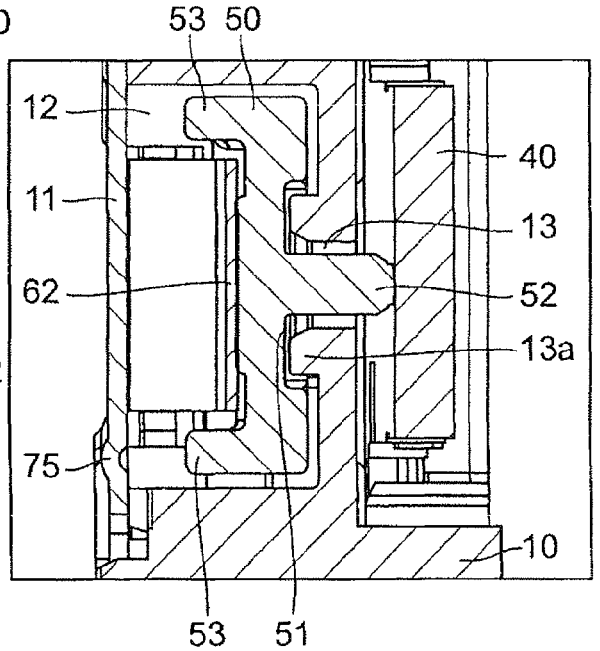
FIG. 4C is a partial enlarged view of FIG. 4B.
Figure 15A:
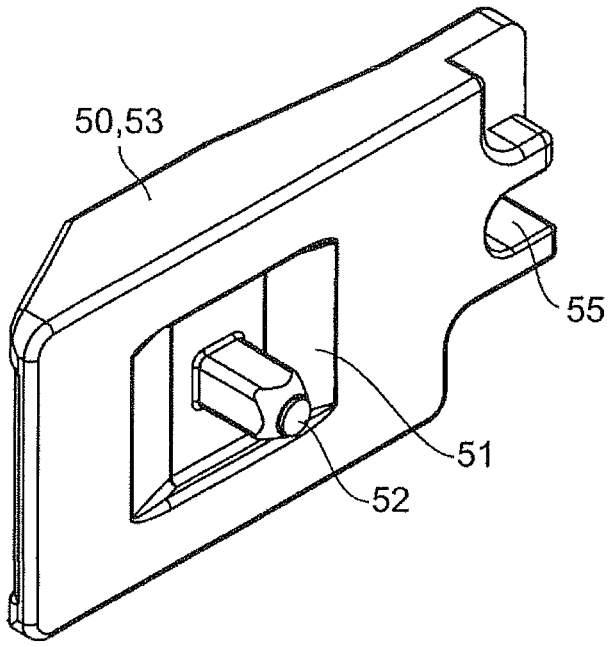
FIGS. 15A, 15B are perspective views of a card illustrated in FIGS. 2, 3.
Figure 15B:
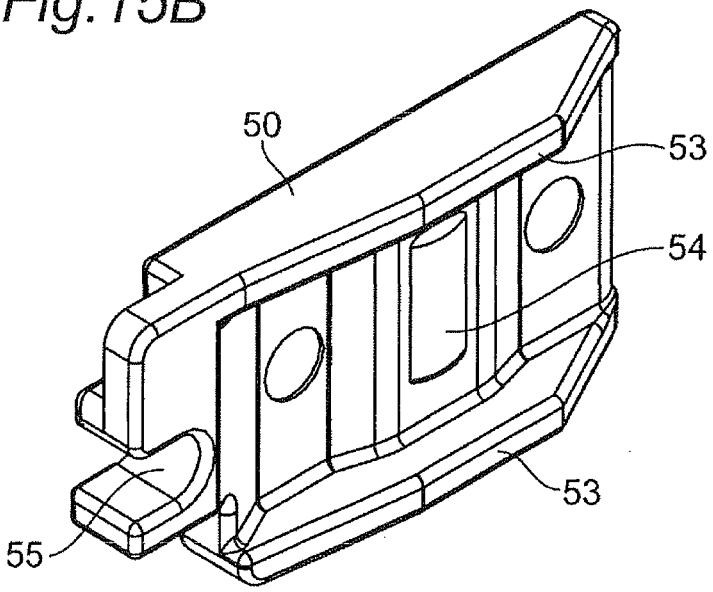
Figure 16B:
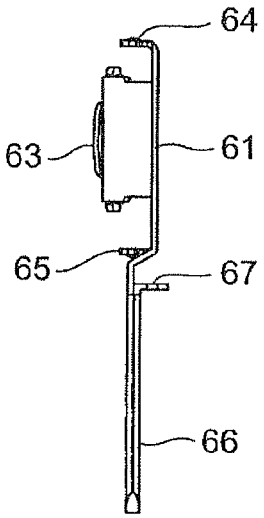
FIG. 16A to FIG. 16D are an elevational view, a left-side view, a perspective view, and a perspective view viewed from a different angle, respectively, of a movable contact terminal illustrated in FIGS. 2, 3.
Figure 16A:
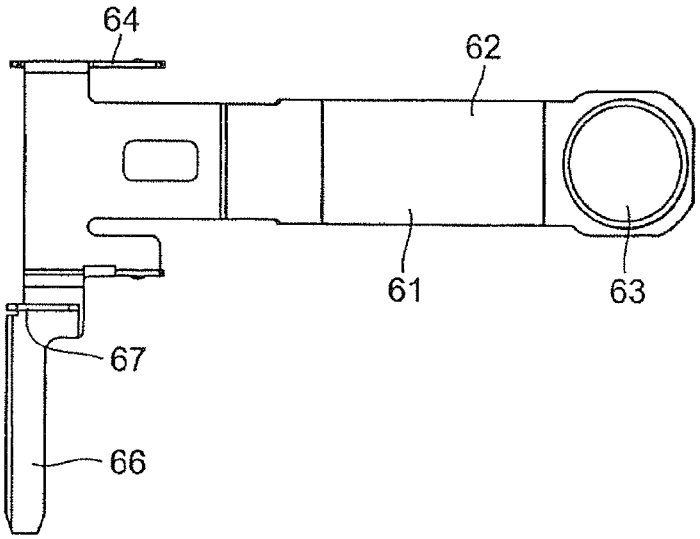
Figure 16C:
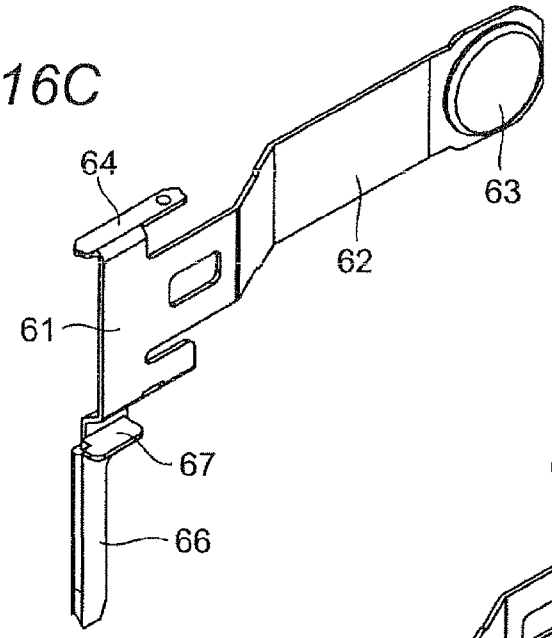
Figure 16D:
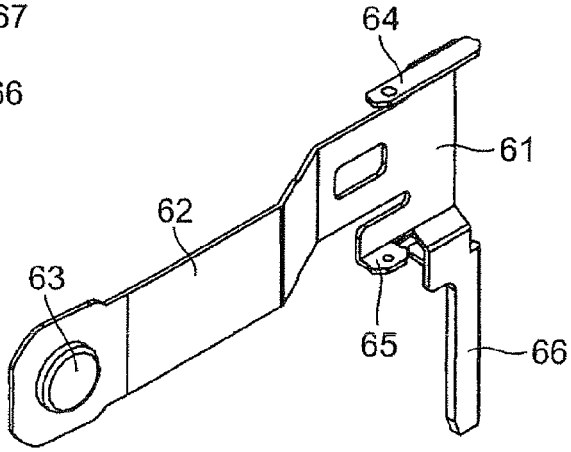

As illustrated in FIGS. 15A-15B, the card 50 has a shape that can be housed in the recess 12 of the base 10 and protrudes an operating protrusion 52 from the bottom face of an operating recess 51 formed at the center of the front face thereof. The operating recess 51 has an outside dimension that can be fitted onto the square surrounding rib 13*a* (FIG. 4C). The card 50 protrudes a pair of insulating ribs 53, 53 on the upper and lower edges on the back side thereof and forms a protrusion 54 being in contact with a movable contacting piece 62 described below on the same axis with the operating protrusion 52. The insulating ribs 53 are for increasing an insulation distance by partitioning the upper and lower edges of the movable contacting piece 62 described below (FIG. 4C). The card 50 forms a notch 55 that is fitted onto the support protrusion 12*a* formed on the base 10.

This causes the operating protrusion 52 and the notch 55 of the card 50 to be assembled to the operating hole 13 and the support protrusion 12*a*, respectively, of the base 10.

As illustrated in FIGS. 2, 3, the contact mechanism 60 includes a movable contact terminal 61 and a fixed contact terminal 70.

As illustrated in FIGS. 16A-16D, the movable contact terminal 61 crimps a movable contact 63 onto the free end of the movable contacting piece 62 extended sideward from the side edge thereof. A pressing-in tongue piece 64 is cut and raised from the upper edge of the movable contacting piece 62, whereas a pressing-in tongue piece 65 is cut and raised from the lower edge thereof, and a terminal 66 extends therefrom. The terminal 66 folds two bending margins stamped by press working and bends and raises the upper edge of the bending margins to form a seal stopper 67. The corners of the tip of the movable contacting piece 62 are cut off to increase an insulation length with the fixed contact terminal 70 described below through the inner face of the base 10, thereby increasing insulating property.

The pressing-in tongue pieces 64, 65 of the movable contact terminal 61 are pressed in the pressing-in grooves 19*a*, 19*b* of the base 10, whereas the base of the terminal 66 is fitted into the movable contact terminal notch 18*a* of the base 10. This causes the seal stopper 67 of the movable contact terminal 61 to block the movable contact terminal notch 18*a* (FIG. 6B) and causes the movable contacting piece 62 to come into contact with the protrusion 54 of the card 50.

Figure 17A:
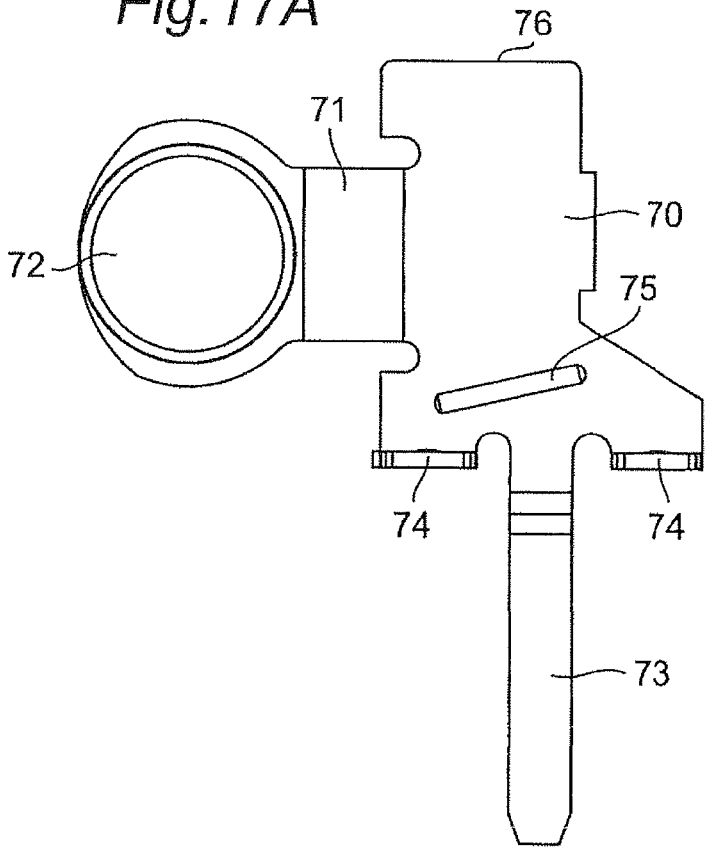
FIG. 17A to FIG. 17C are an elevational view, a perspective view, and a perspective view viewed from a different angle, respectively, of a fixed contact terminal illustrated in FIGS. 2, 3.
Figure 17B:
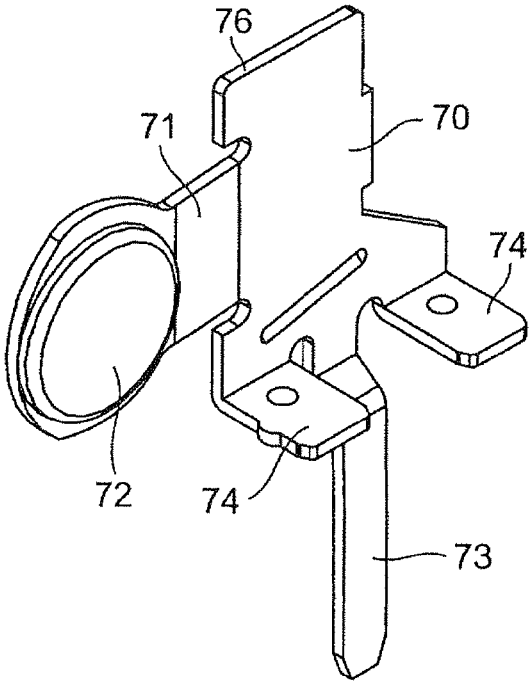
Figure 17C:
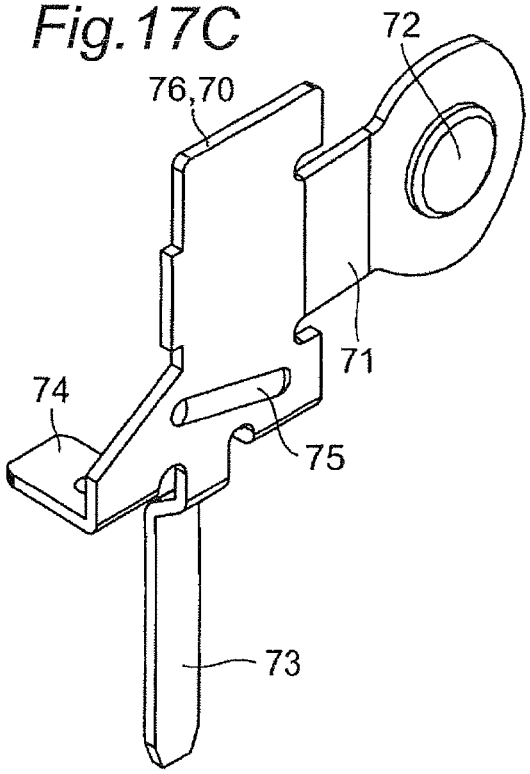

As illustrated in FIGS. 17A-17C, the fixed contact terminal 70 crimps a fixed contact 72 onto the tip of a fixed contacting piece 71 extended sideward from the side edge thereof, extends a terminal 73 from the lower edge thereof, and cuts and raises pressing-in ribs 74, 74 from both edges thereof. A seal stopper 75 is formed at the back of the base of the terminal 73 by ejection working. The fixed contacting piece 71 forms its tip to be an arc shape along the circumference of the fixed contact 72, and in particular, cuts off the tip edge thereof so as to be flush with the fixed contact 72. This is because the insulation distance to the movable contact terminal 61 through the inner face of the base 10 and the insulation distance to the coil terminals 37, 38 are increased, thereby improving insulation property.

The pressing-in ribs 74, 74 of the fixed contact terminal 70 are pressed in the pressing-in grooves 19*c*, 19*c* of the base 10, an upper end 76 is positioned onto the fixed contact terminal positioning step 17 formed on the insulating wall 11, and the base of the terminal 73 is fitted into the fixed contact terminal notch 18*b*. Next, a sealant (not illustrated) is injected into the seal reservoirs 17*a* formed in the fixed contact terminal positioning step 17 and is cured, thereby fixing the fixed contact terminal 70 to the base 10 and causing the fixed contact 72 to face the movable contact 63 in a contactable and separable manner.

Abrasion powder that occurs with the opening and closing of a contact usually adheres to and accumulates in the inner face of the base 10, thereby causing a fixed contact and a movable contact to be likely to be electrically short-circuited and causing insulation deterioration. In contrast, one or more embodiments of the present invention cuts off the tip of the movable contacting piece 62 and the tip of the fixed contacting piece 71. This causes the advantage of increasing the insulation distance between the fixed contact 72 and the base 10 (the inner face of the recess 12) or the insulation distance between the movable contact 63 and the base 10 (the inner face of the recess 12) and preventing insulation deterioration.

Figure 18:
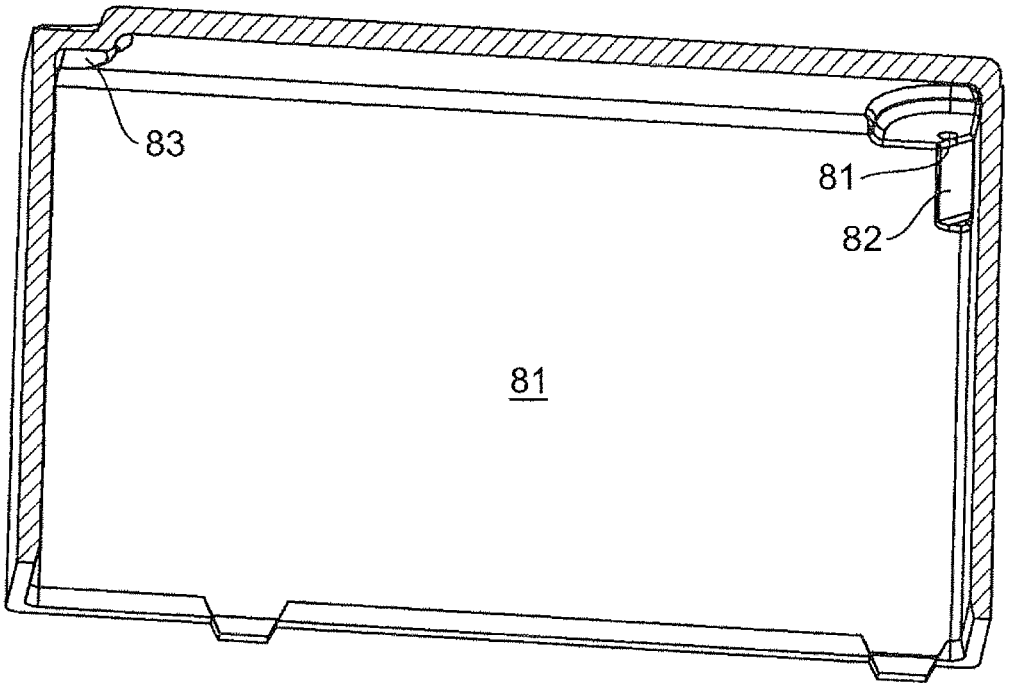
FIG. 18 is a sectional perspective view of a case illustrated in FIGS. 2, 3.

As illustrated in FIGS. 2, 3, the case 80 has a box shape that can be fitted onto the base 10 and forms a hole 81 at a corner on the top face thereof. As illustrated in FIG. 18, the case 80 integrally forms a positioning protrusion 82 at a corner of the ceiling thereof that comes into contact with a tapered part 21*a* (FIGS. 1A-1B) of the spool 21 to prevent wrong insertion. The case 80 includes a step 83 at a corner on the short side thereof for avoiding a defect caused by a gate during molding.

After fitting the case 80 onto the base 10 to which the internal components have been assembled, a sealant (not illustrated) is injected to the bottom face of the base 10 and is cured to seal. When the case 80 is fitted onto the base 10, the seal stopper 75 of the fixed contact terminal 70 is positioned near the inner face of the case 80. This causes the seal stopper 67 formed on the movable contact terminal 61 and the seal stopper 75 formed on the fixed contact terminal 70 to prevent the sealant from entering, thereby preventing the occurrence of operation failure and contact failure.

Next, the hole 81 of the case 80 is heat sealed to complete the assembly working.

Next, the operation of the electromagnetic relay according to one or more embodiments of the present invention will be described.

Figure 13A:
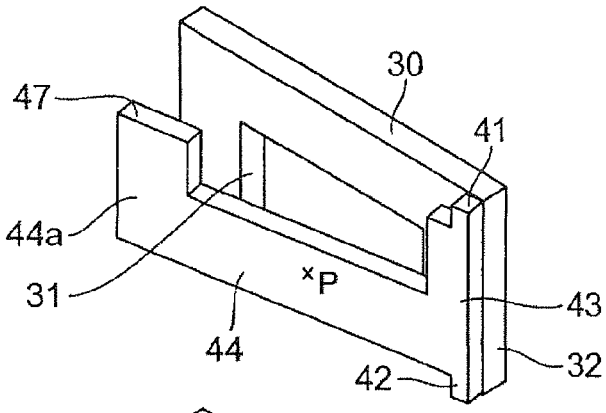
FIG. 13A to FIG. 13D are perspective views for illustrating the motion of the movable iron piece.
Figure 13B:
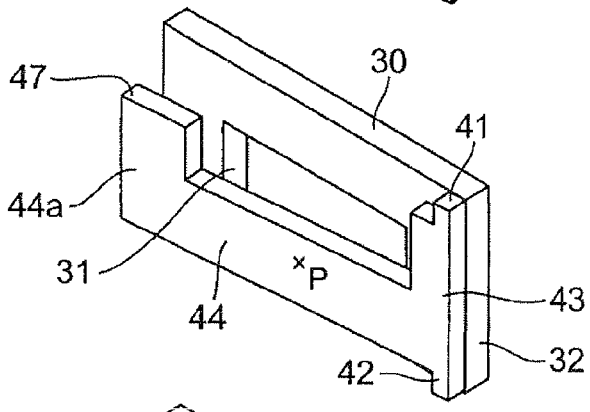

When no voltage is applied to the coil 39 of the electromagnet 20, the card 50 is biased toward the insulating wall 11 through the spring force of the movable contacting piece 62. The movable contact 63 is separate from the fixed contact 72, whereas the tip 44*a* of the pivoting arm 44 of the movable iron piece 40 is separate from the gate-shaped iron core 30 (FIG. 13A).

Figure 13C:
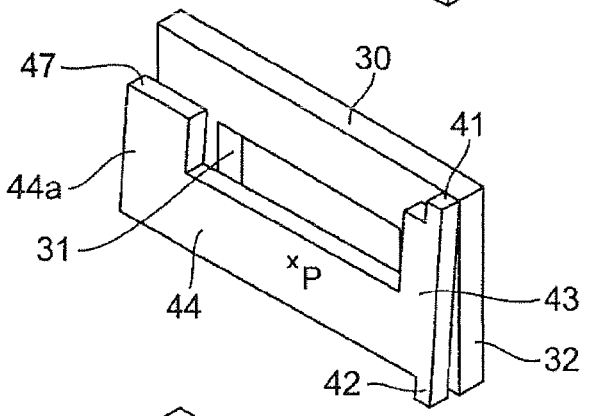
Figure 13D:
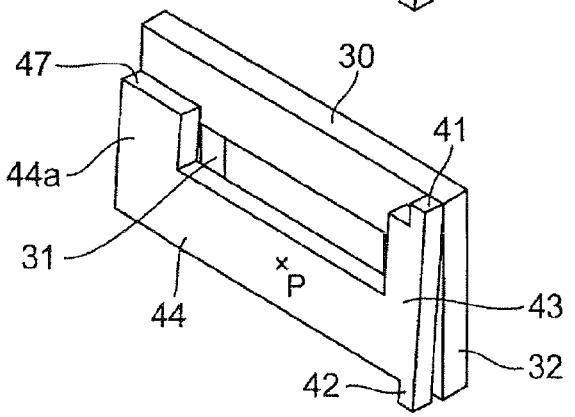

When a voltage is applied to the coil 39 of the electromagnet 20 to excite it, the tip 44*a* of the pivoting arm 44 of the movable iron piece 40 is attracted, thereby pivoting the movable iron piece 40 about the shafts 41, 42. When the pivoting arm 44 presses in the operating protrusion 52 of the card 50 (FIG. 13B), a torsional moment about a line connecting between the shaft 41 and the pressing point P acts. This causes the shaft 42 to separate from the gate-shaped iron core 30 and causes the tip edge of the extended part 47 extended from the tip 44*a* of the movable iron piece 40 to approach the gate-shaped iron core 30 (FIG. 13C). Next, the tip edge of the extended part 47 is attracted to the gate-shaped iron core 30 to reach a stable state (FIG. 13D). This causes the card 50 to be pushed in to a final position and brings the movable contact 63 of the movable contacting piece 62 that has deformed in the plate thickness direction into contact with the fixed contact 72.

The first embodiment forms the shallow groove 33 as the magnetic flux density reduction mechanism on the lower part of the leg 32 of the gate-shaped iron core 30, thereby increasing magnetic resistance and reducing magnetic flux density. This causes the shaft 42 of the movable iron piece 40 to separate from the gate-shaped iron core 30 at an early stage of a stroke when a torsional moment acts on the movable iron piece 40. This causes an advantage that an electromagnetic relay that has no variation in operating voltage and has stable operating characteristics is achieved.

The magnetic flux density reduction mechanism is not limited to the shallow groove 33 and may be formed a protrusion or a nonmagnetic body such as a magnetic shielding plate and copper plating, for example.

The magnetic flux density reduction mechanism may be formed on both or either one of the gate-shaped iron core 30 and the movable iron piece 40.

The magnetic flux density reduction mechanism may combine the shallow groove 33, the protrusion, and the magnetic shielding plate. The gate-shaped iron core 30 forms the shallow groove 33 and the nonmagnetic body, for example.

Next, when the voltage application to the coil 39 stops, the card 50 is pressed back through the spring force of the movable contacting piece 62, and the operating protrusion 52 of the card 50 presses back the pivoting arm 44 of the movable iron piece 40, thereby returning to the original state.

Figure 19A:
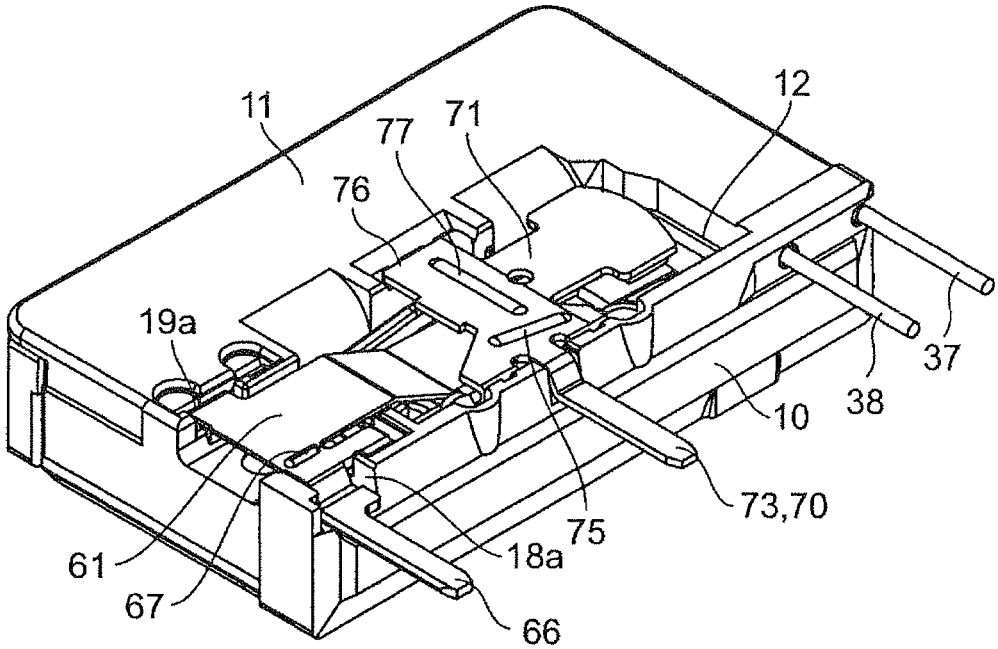
FIGS. 19A, 19B are a perspective view and a partial enlarged perspective view, respectively, of an electromagnetic relay indicating a second embodiment of the present invention.
Figure 19B:
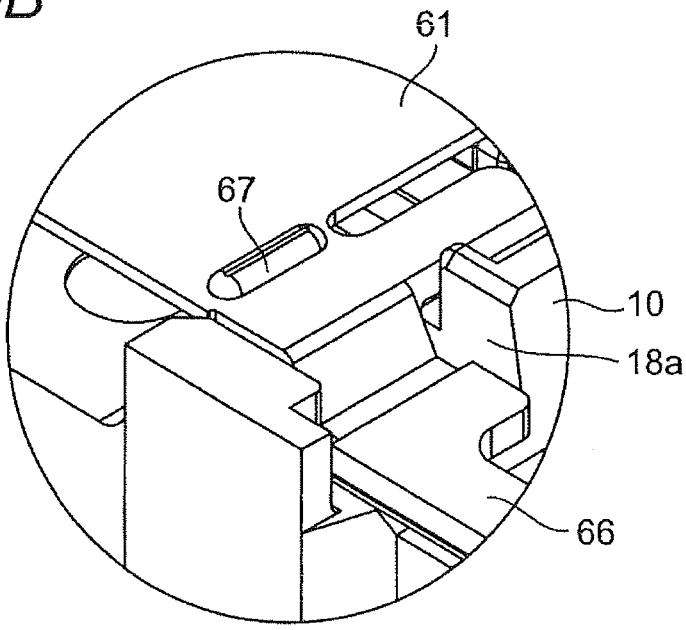

As illustrated in FIGS. 19A-19B, the second embodiment of the present invention is a case in which the seal stopper 67 is formed at the back of the base of the terminal 66 of the movable contact terminal 61 by ejection working, whereas a reinforcing protrusion 77 is formed on the fixed contact terminal 70 by ejection working.

The second embodiment has the advantage of being high in the yield of the material and being easy to manufacture.

Because the others are similar to the first embodiment, the same reference numerals are attached to the same parts, and the description thereof is omitted.

Figure 20A:
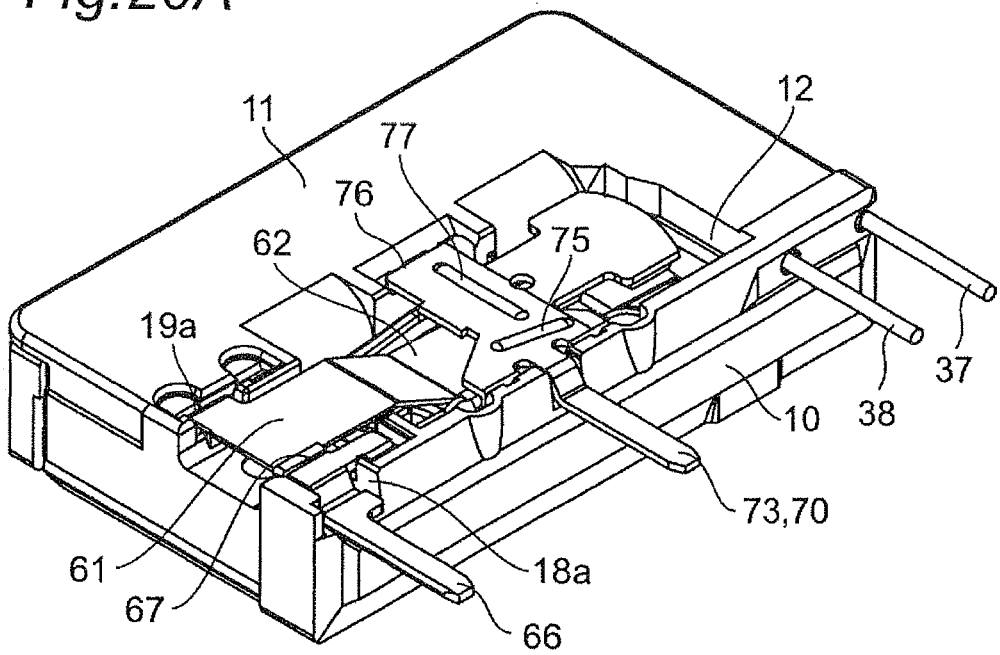
FIGS. 20A, 20B are a perspective view and a partial enlarged perspective view, respectively, of an electromagnetic relay indicating a third embodiment of the present invention.
Figure 20B:
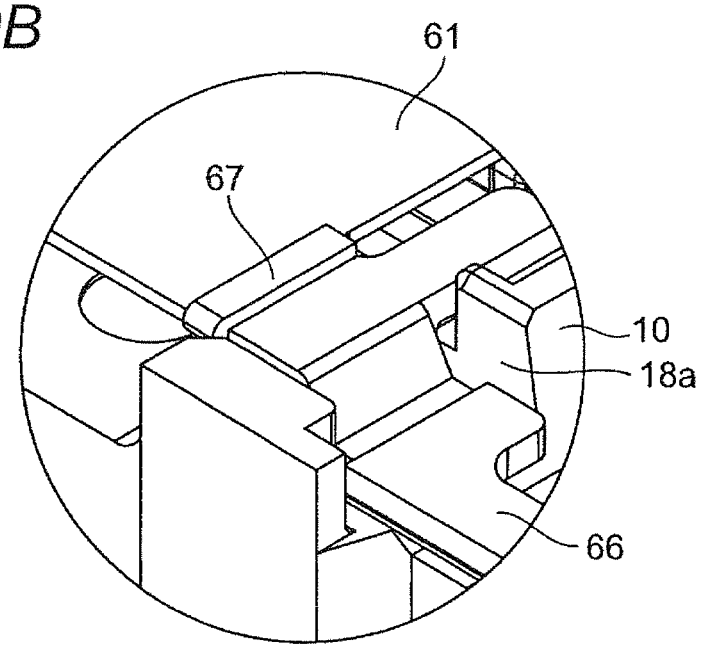

As illustrated in FIGS. 20A-20B, the third embodiment of the present invention is a case in which the seal stopper 67 is formed by cutting out an edge at the back of the base of the terminal 66 of the movable contact terminal 61 and bending it.

The third embodiment has the advantage of preventing the intrusion of the sealant more surely owing to the long seal stopper 67 being close to the inner side face of the case 80.

Because the others are similar to one or more of the above embodiments, the same reference numerals are attached to the same parts, and the description thereof is omitted.

Figure 21A:
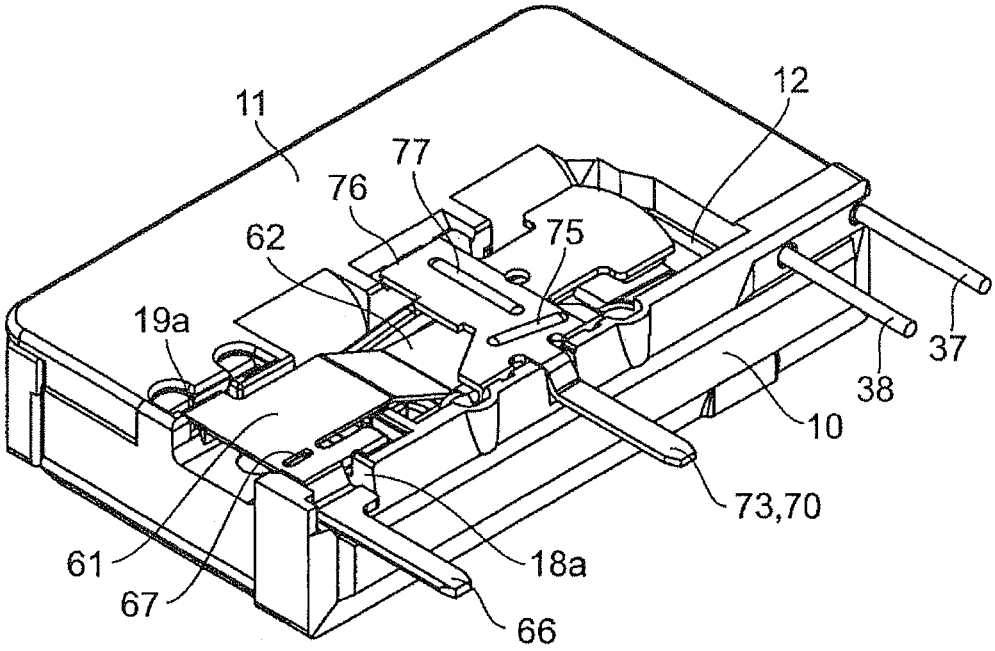
FIGS. 21A, 21B are a perspective view and a partial enlarged perspective view, respectively, of an electromagnetic relay indicating a fourth embodiment of the present invention.
Figure 21B:
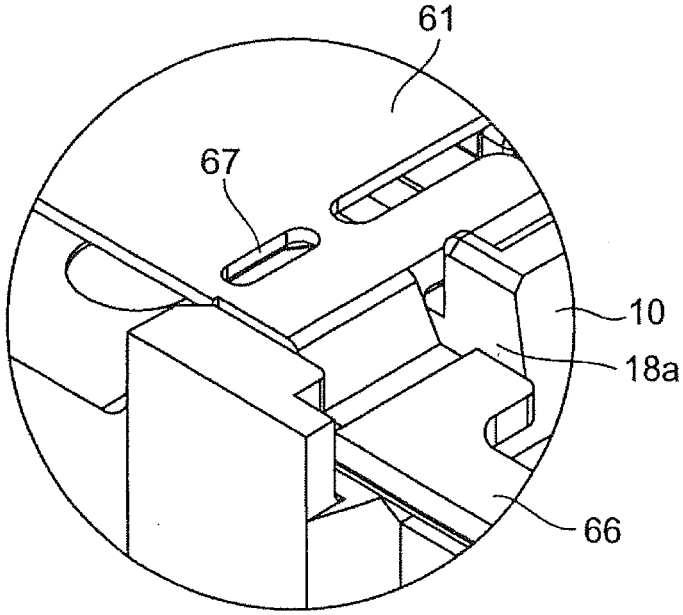

As illustrated in FIGS. 21A-21B, the fourth embodiment of the present invention is a case in which a through hole as the seal stopper 67 is formed at the back of the base of the terminal 66 of the movable contact terminal 61 by punching working.

The fourth embodiment has the advantage of being high in the yield of the material and being easy to manufacture.

Figure 22A:
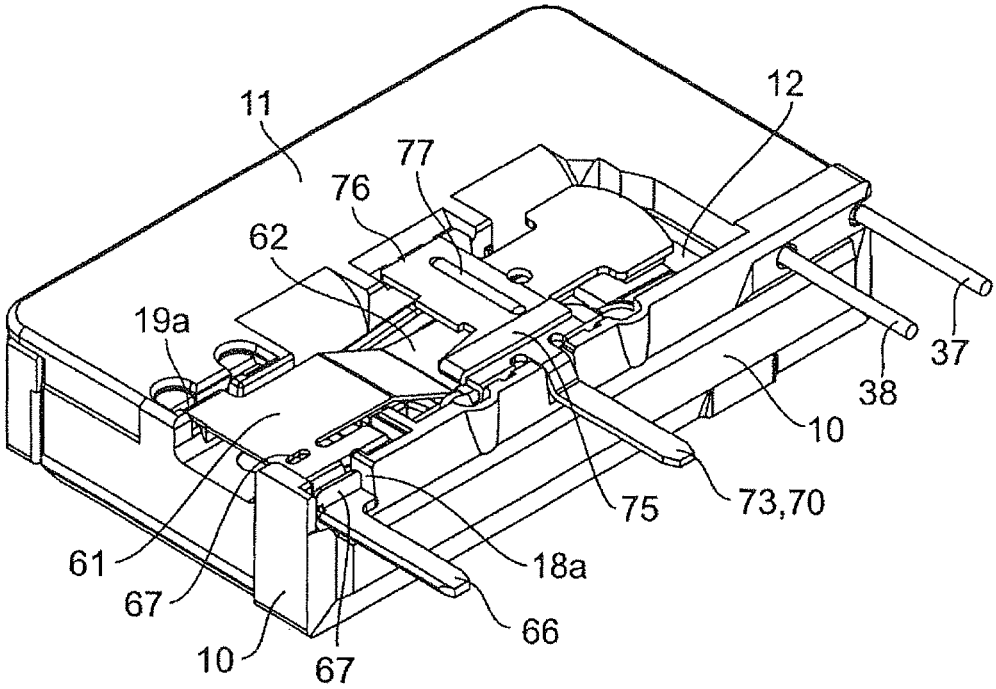
FIGS. 22A, 22B are a perspective view and a partial enlarged perspective view, respectively, of an electromagnetic relay indicating a fifth embodiment of the present invention.
Figure 22B:
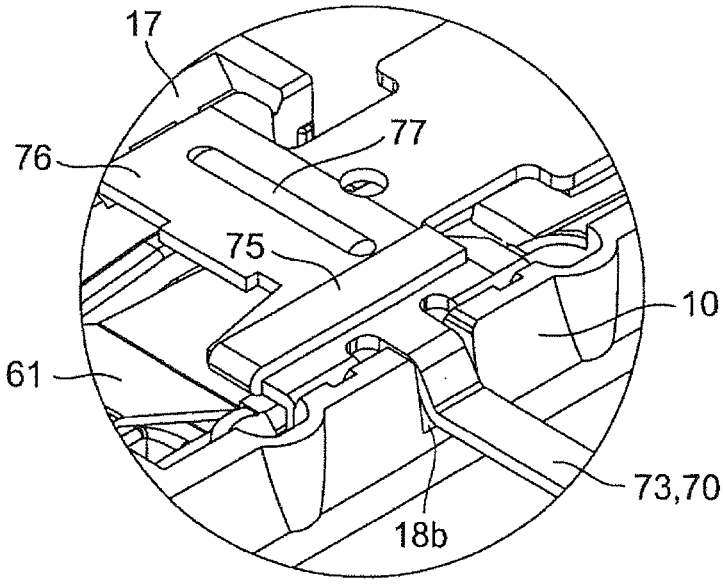
Figure 23A:
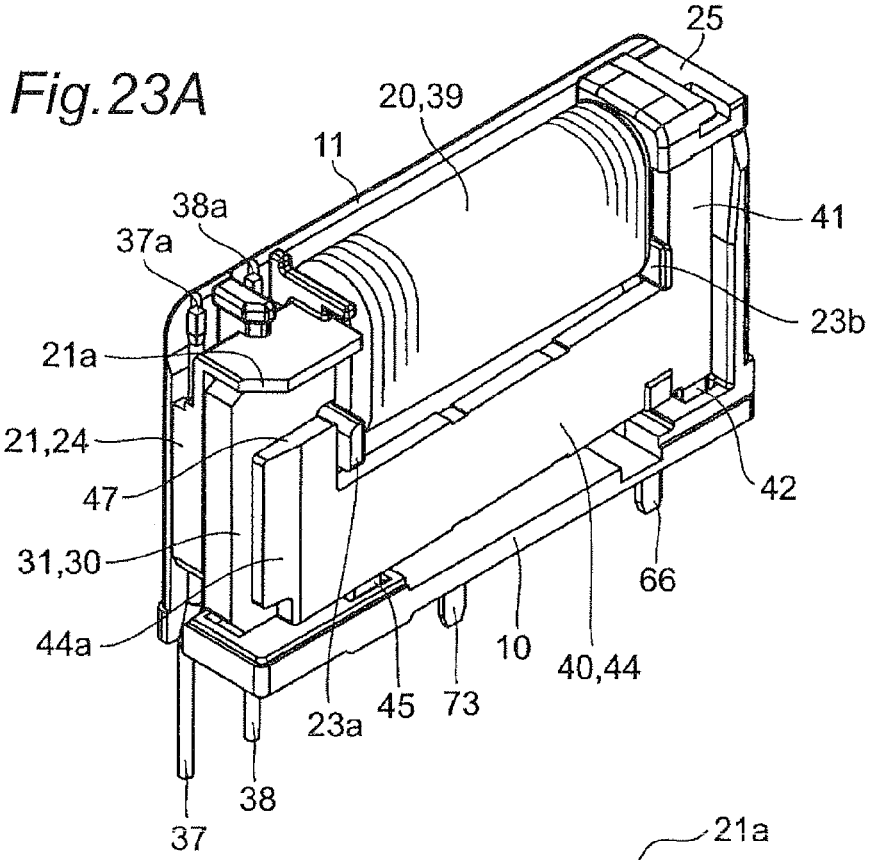
FIGS. 23A, 23B are a perspective view and a partial enlarged perspective view, respectively, of an electromagnetic relay indicating a sixth embodiment of the present invention.
Figure 23B:
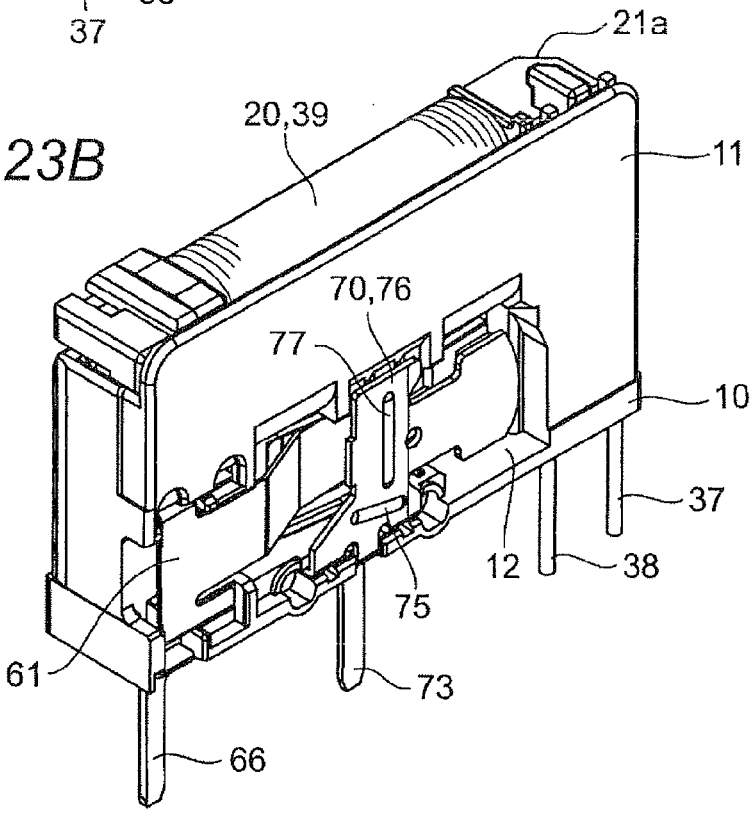

As illustrated in FIGS. 22A-22B, the fifth embodiment of the present invention is a case in which the long seal stopper 75 closed to the inner side face of the case 80 is formed by cutting out an edge at the back of the base of the terminal 73 formed on the fixed contact terminal 70.

The fifth embodiment has the advantage of preventing the intrusion of the sealant more surely owing to the long seal stopper 75 being close to the inner side face of the case 80.

As illustrated in FIG. 23A to FIG. 25, the sixth embodiment of the present invention is nearly similar to the first embodiment and is different therefrom in that it has a twin-contact structure.

Figure 24:
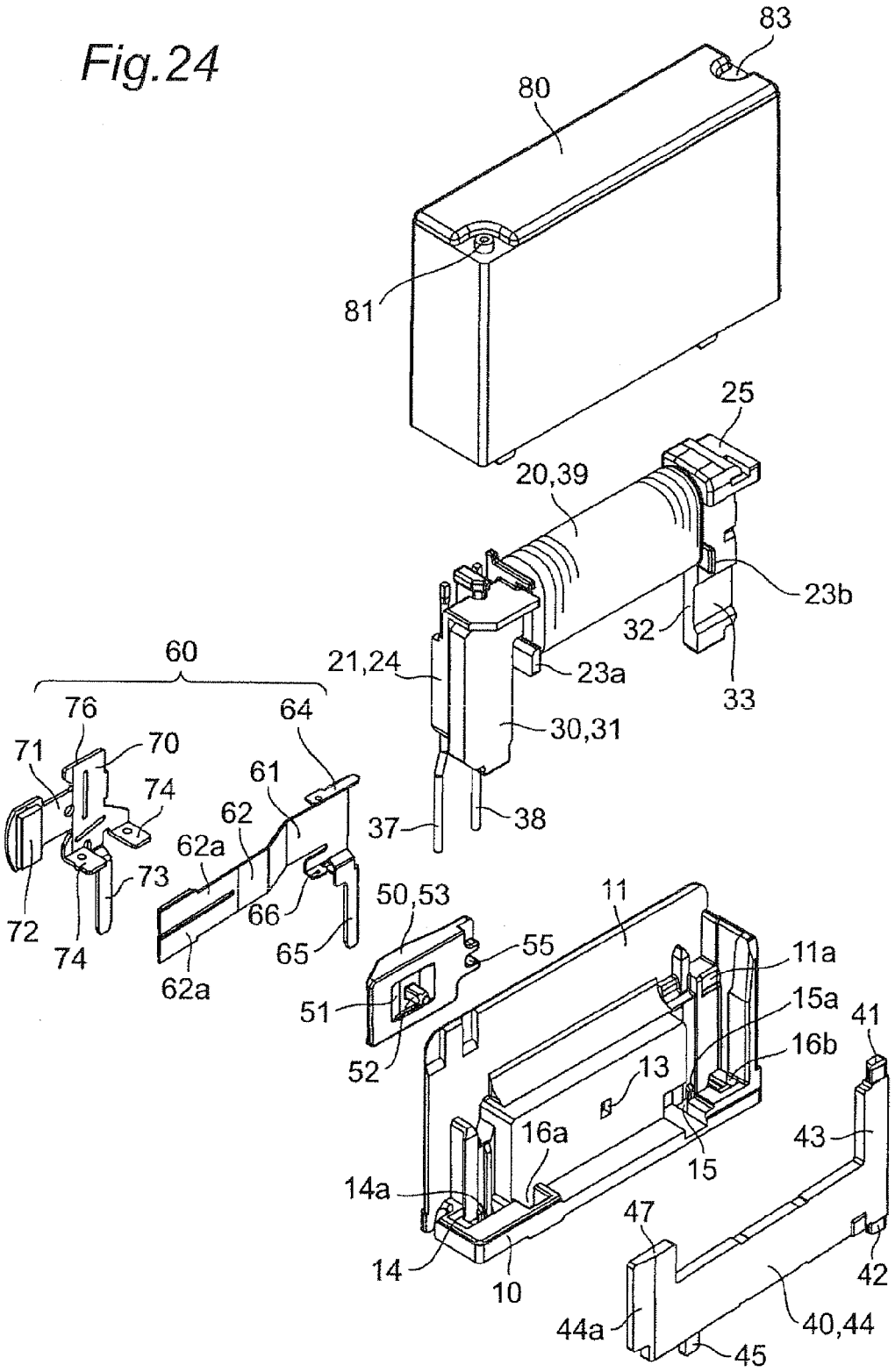
FIG. 24 is an exploded perspective view of the sixth embodiment viewed from the same viewpoint as that of FIG. 23A.
Figure 25:
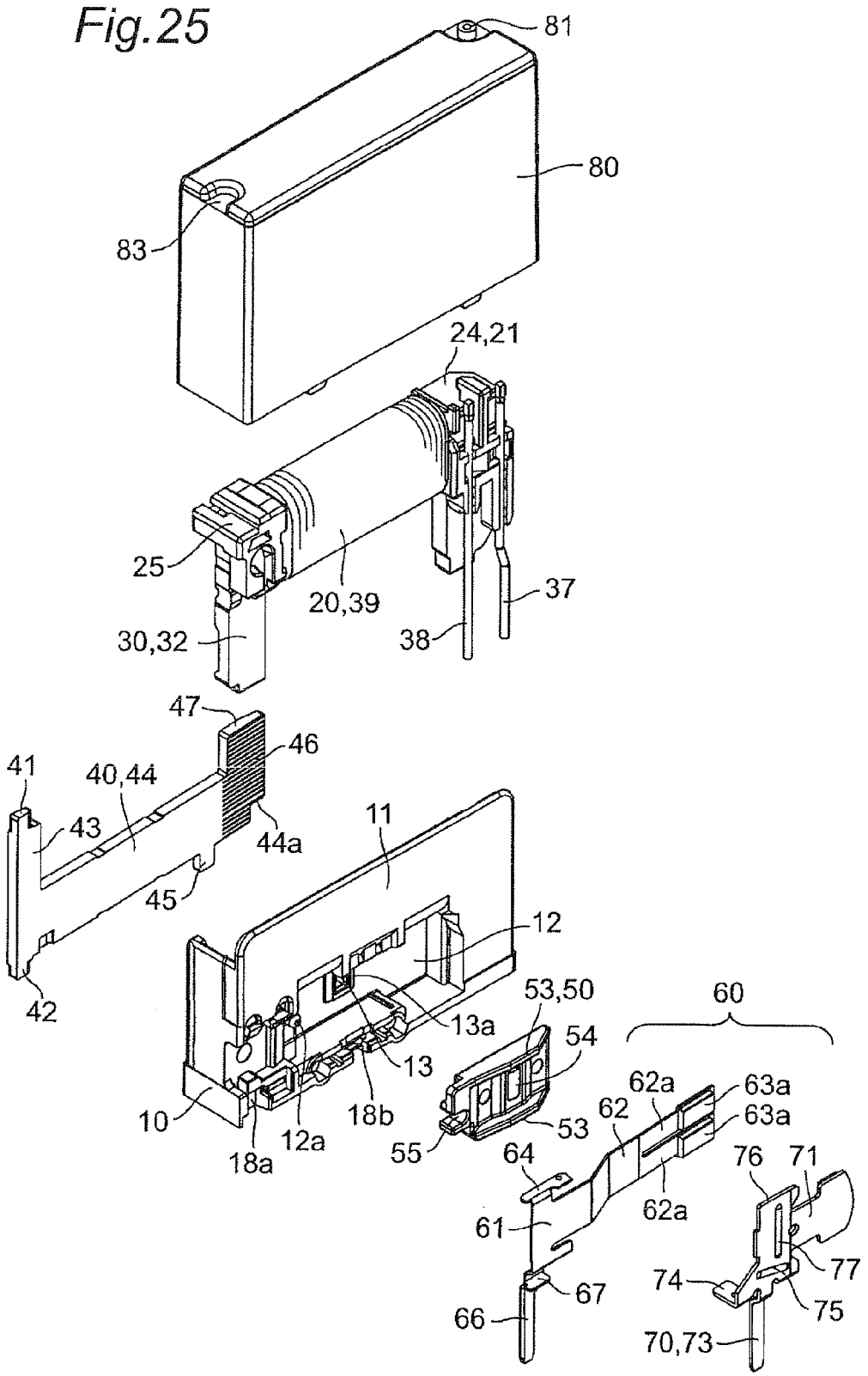
FIG. 25 is an exploded perspective view of the sixth embodiment viewed from the same viewpoint as that of FIG. 23B.

Specifically, as illustrated in FIGS. 24, 25, the tip of the movable contacting piece 62 is split into two pieces in the width direction to form split pieces 62*a*, 62*a*, and movable contacts 63*a* are formed at the free end of the split pieces 62*a*. The rod-shaped fixed contact 72 is formed at the free end of the fixed contacting piece 71 to form a crossbar contact structure. The sixth embodiment has the advantage of achieving an electromagnetic relay having high contact reliability.

Because the others are nearly similar to the first embodiment, the same reference numerals are attached to the same parts, and the description thereof is omitted.

Example 1

Figure 14A:
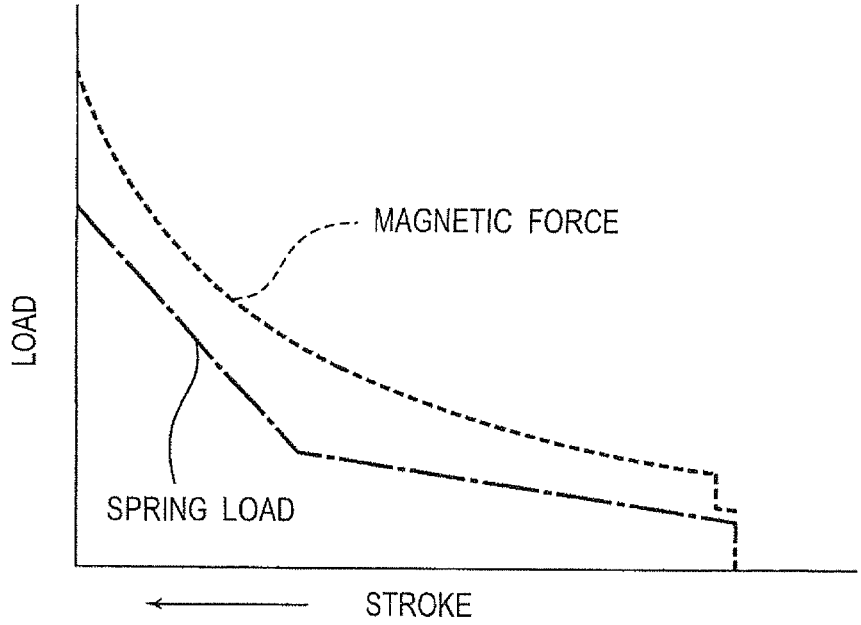
FIG. 14A and FIG. 14B are graph diagrams illustrating the relation between a spring load acting on a pressing point P and magnetic force by a coil.

The magnetic characteristics of the electromagnetic relay according to the present example were measured. The measurement result is illustrated in FIG. 14A. The magnetic characteristics of an electromagnetic relay according to a conventional example were measured. The measurement result is illustrated in FIG. 14B.

Figure 14B:
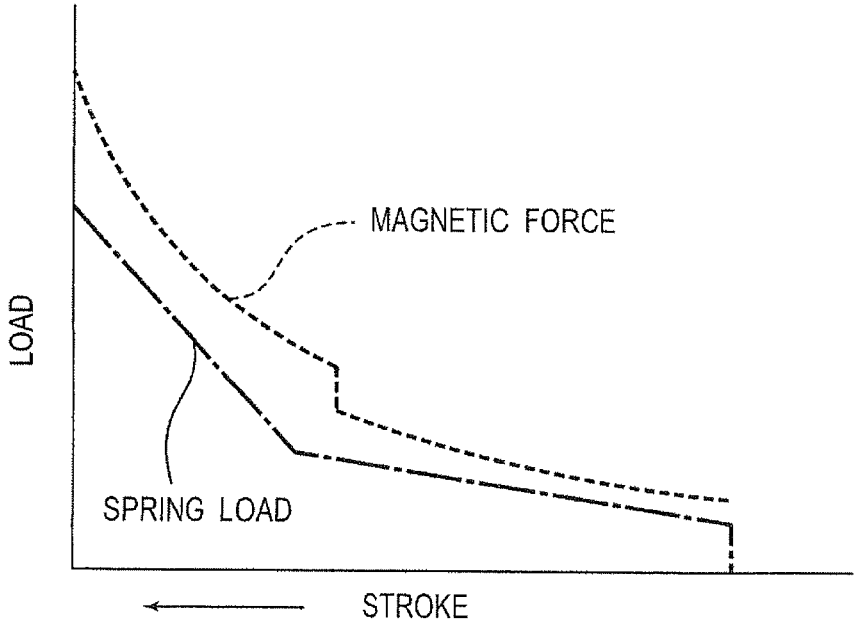

In the graph diagrams of FIG. 14A and FIG. 14B, the vertical axis indicates a load applied to the pressing point P, whereas the horizontal axis means a stroke as the amount of movement of the card. The right end of the graph diagrams indicates a state in which no voltage is applied to the coil, that is, a state in which the card is not moved. It is indicated that the more left in the graph diagrams, the more voltage is applied to the coil to move the card.

One or more embodiments of the present invention causes the shaft 42 of the movable iron piece 40 to separate from the leg 32 of the gate-shaped iron core 30 and causes the tip edge of the extended part 47 to approach the leg 31 of the gate-shaped iron core 30 (FIG. 13C). As is clear from FIG. 14A, this suddenly increases a magnetic force indicated by the dotted line caused by the coil at an early stage of the stroke. In contrast, the conventional example illustrated in FIG. 14B delays a point at which the magnetic force suddenly increases.

In other words, one or more embodiments of the present invention makes it easier for the shaft 42 of the movable iron piece 40 to separate from the leg 32 of the gate-shaped iron core 30 by arranging the magnetic flux density reduction mechanism, thereby suddenly increasing the magnetic force at an early stage of the stroke. This achieves an electromagnetic relay that can prevent variations in operating voltage and has stable operating characteristics.

There is another effect that can prevent possible inoperability owing to that a spring load acting on the pressing point P indicated by the dot-and-dash line exceeds the magnetic force caused by the coil when the point at which the magnetic force suddenly increases is too late.

It is understood that the electromagnetic relay according to one or more embodiments of the present invention can be used in other electromagnetic relays without being limited to the above electromagnetic relay.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

REFERENCE SIGNS LIST

10 Base
11 Insulating wall
11*a* Positioning recess
12 Recess
12*a* Support protrusion
13 Operating hole
13*a* Surrounding rib
14, 15 Pressing-in recess
14*a*, 15*a* Crushing protrusion
16*a* Retaining hole
16*b* Shaft receiving part
17 Fixed contact terminal positioning step
17*a* Seal reservoir
17*b* Ventilation groove
18*a* Movable contact terminal notch
18*b* Fixed contact terminal notch
20 Electromagnet
21 Spool
21*a* Tapered part

22, 23 Rod-shaped connecting member
24, 25 Collar
24*a*, 24*b* Pressing-in groove
25*a* Shaft receiving part
30 Gate-shaped iron core
31, 32 Leg
33 Shallow groove
34 Protruding protrusion
37, 38 Coil terminal
37*a*, 38*a* Binding part
37*b*, 38*b* Whirl-stop
39 Coil
40 Movable iron piece
41, 42 Shaft
43 Pivoting shaft
44 Pivoting arm
44*a* Tip
45 Retaining protrusion
46 Protrusion
47 Extended part
P Pressing point
50 Card
51 Operating recess
52 Operating protrusion
53 Insulating rib
54 Protrusion
55 Notch
60 Contact mechanism
61 Movable contact terminal
62 Movable contacting piece
63 Movable contact
64, 65 Pressing-in tongue piece
66 Terminal
67 Seal stopper
70 Fixed contact terminal
71 Fixed contacting pieces
72 Fixed contact
73 Terminal
74 Pressing-in rib
75 Seal stopper
76 Upper end
77 Reinforcing protrusion
80 Case
81 Hole
82 Positioning protrusion
83 Step

The invention claimed is:

1. An electromagnetic relay, comprising:

an iron core having legs at both ends and a coil wound therearound to form an electromagnet;

a movable iron piece that pivotally supports a pivoting shaft along one leg of the iron core and causes a tip of a pivoting arm extended from a side edge of the pivoting shaft toward the other leg of the iron core to face the other leg of the iron core in a contactable and separable manner; and a card whose side facing the movable iron piece is in contact with the pivoting arm of the movable iron piece, wherein the movable iron piece that pivots based on the excitation and degaussing of the electromagnet presses the card to drive a contact mechanism, and wherein at least one facing plane out of the facing planes of the one leg of the iron core and the pivoting shaft of the movable iron piece comprises a magnetic flux density reduction mechanism.

2. The electromagnetic relay according to claim 1, wherein the magnetic flux density reduction mechanism is a groove.

3. The electromagnetic relay according to claim 2, wherein the tip of the pivoting arm is L-shaped so as to be along the other leg of the iron core.

4. The electromagnetic relay according to claim 1, wherein the magnetic flux density reduction mechanism is a protrusion.

5. The electromagnetic relay according to claim 4, wherein the tip of the pivoting arm is L-shaped so as to be along the other leg of the iron core.

6. The electromagnetic relay according to claim 1, wherein the magnetic flux density reduction mechanism is a nonmagnetic body.

7. The electromagnetic relay according to claim 6, wherein the tip of the pivoting arm is L-shaped so as to be along the other leg of the iron core.

8. The electromagnetic relay according to claim 1, wherein the tip of the pivoting arm is L-shaped so as to be along the other leg of the iron core.

* * * * *